US008425723B2

(12) United States Patent
Wild

(10) Patent No.: US 8,425,723 B2
(45) Date of Patent: Apr. 23, 2013

(54) PROCESS FOR IMPROVING OPTICAL PROPERTIES OF PAPER

(75) Inventor: Martha Patricia Wild, Atlanta, GA (US)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 12/594,477

(22) PCT Filed: Apr. 3, 2008

(86) PCT No.: PCT/US2008/059250

§ 371 (c)(1), (2), (4) Date: Oct. 22, 2009

(87) PCT Pub. No.: WO2008/124489

PCT Pub. Date: Oct. 16, 2008

(65) Prior Publication Data

US 2010/0132901 A1 Jun. 3, 2010

Related U.S. Application Data

(60) Provisional application No. 60/922,057, filed on Apr. 5, 2007, provisional application No. 61/032,588, filed on Feb. 29, 2008.

(51) Int. Cl.
*D21H 11/00* (2006.01)

(52) U.S. Cl.
USPC ..... 162/164.1; 162/158

(58) Field of Classification Search ..... 162/164.1, 162/158, 181.6
See application file for complete search history.

(56) References Cited

U.S. PATENT DOCUMENTS

| | | | |
|---|---|---|---|
| 4,070,236 | A | 1/1978 | Carrard et al. |
| 4,169,810 | A | 10/1979 | Günther et al. |
| 5,098,520 | A | 3/1992 | Begala |
| 5,176,891 | A | 1/1993 | Rushmere |
| 5,185,062 | A | 2/1993 | Begala |
| 5,482,514 | A | 1/1996 | von Raven |
| 5,755,930 | A | 5/1998 | Satterfield et al. |
| 5,902,454 | A | 5/1999 | Nelson |
| 6,426,382 | B1 | 7/2002 | Farrar et al. |
| 6,551,457 | B2 | 4/2003 | Westman et al. |
| 6,723,845 | B2 | 4/2004 | Iishi et al. |
| 6,723,846 | B1 | 4/2004 | Metzger et al. |
| 6,890,454 | B2 | 5/2005 | Farrar et al. |
| 6,893,473 | B2 | 5/2005 | Neogi et al. |
| 2003/0013628 | A1 | 1/2003 | Farrar et al. |
| 2004/0014910 | A1 | 1/2004 | Wang |
| 2005/0124755 | A1 | 6/2005 | Mitchell et al. |
| 2006/0185808 | A1 * | 8/2006 | Nguyen ..... 162/162 |

FOREIGN PATENT DOCUMENTS

| | | | |
|---|---|---|---|
| EP | 1 086 825 | A1 | 3/2001 |
| EP | 1 378 545 | A1 | 1/2004 |
| JP | 04-153393 | A | 5/1992 |
| JP | 2000-006515 | A | 11/2000 |
| JP | 2004-277900 | A | 7/2004 |
| WO | WO 95/21295 | A1 | 8/1995 |
| WO | WO 95/21296 | A1 | 8/1995 |
| WO | WO 96/00221 | A1 | 1/1996 |
| WO | WO 99/67310 | A1 | 12/1999 |
| WO | WO 00/49227 | A1 | 8/2000 |
| WO | WO 02/12626 | A1 | 2/2002 |
| WO | WO 2006/045714 | A1 | 5/2006 |
| WO | 2006/089274 | A1 | 8/2006 |

OTHER PUBLICATIONS

International Search Report for International Application No. PCT/US2008/059250 dated Jul. 28, 2008.

Sears, Jr., George W., "Determination of Specific Surface Area of Colloidal Silica by Titration with Sodium Hydroxide," Analytical Chemistry 28, vol. 12 (1956) pp. 1981-1983.

SWE 03187 P1-CN Chinese Office Action for CN Patent Application No. 2008800187773 dated Oct. 18, 2011.

SWE 03187 P1-CN English translation of Chinese Office Action for CN Patent Application No. 2008800187773 dated Oct. 18, 2011.

Huang Juhong, et al, "The Selection and Application of Fluorescent Whitening Agents for the Modern Paper Industry", Paper Chemicals, No. 3, 2002, pp. 20-25, and 36.

SWE 03187 P1-JP Office Action for Japanese Patent Application No. 2010-502288 dated Aug. 8, 2012.

SWE 03187 P1-JP English language machine translation for Office Action for Japanese Patent Application No. 2010-502288 dated Aug. 8, 2012.

Patent Abstracts of Japan for JP 2004-277900 A dated Jul. 10, 2004.

Patent Abstracts of Japan for JP 2000-006515 A dated Nov. 1, 2000.

Patent Abstracts of Japan for JP 04-153393 A dated May 26, 1992.

* cited by examiner

*Primary Examiner* — Mark Halpern
(74) *Attorney, Agent, or Firm* — Robert C. Morriss

(57) ABSTRACT

The present invention is directed to a method of efficiently maintaining or increasing brightness and whiteness of refined paper. In one aspect, the invention is directed to a method for substantially maintaining (or even increasing) brightness and/or whiteness of paper with increased pulp refining, the method including refining the pulp down to reduce the freeness at least about 100 CSF and adding a combination of an OBA and a carrier polymer to the paper surface in the size press in amounts sufficient to increase brightness and/or whiteness of the final paper. In another aspect, the invention is directed to a method of making paper from refined pulp that includes refining a cellulosic fiber suspension to reduce the freeness at least about 100 CSF and contacting the cellulosic fibers with at least one optical brightening agent (OBA) during or after the refining step prior to adding any additional wet end chemicals.

13 Claims, 21 Drawing Sheets

First Generation Nanoparticle BMA-0

Third Generation NP

Brightness decrease of softwood pulp and paper due to refining

Brightness decrease of hardwood pulp (D2 stage) and paper due to refining

Brightness decrease of hardwood pulp (D1 stage) and paper due to refining

Refining decreases brightness of the paper

Refining decreases the whiteness of the paper

Two pH levels and their effect on brightness and whiteness

Unusual brightness peak at around the fiber delamination point

Unusual whiteness peak at around the fiber delamination point

OBA has higher brightness increase when compared to other chemicals

Effect of OBA combined with a second chemical

Effect of wet end and size press OBA on wet end chemical sequences 4-chem sequence brightness comparison for wet end and size press OBA additions 4-chem sequence whiteness comparison for wet end and size press OBA additions 5-chem sequence brightness comparison for wet end and size press OBA additions 5-chem sequence whiteness comparison for wet end and size press OBA additions 6+-chem sequence B & W comparison for wet end and size press OBA additions.

Effect of wet end chemicals at the wet end on brightness

Effect of different wet end chemicals on brightness

Effect of different wet end chemicals on whiteness

Effect of OBA Dose on Brightness Paper

Effect of OBA on Brightness and Whiteness of Paper

Effect of PVOH solids on Brightness Performance

Effect of PVOH 09-325 and 24-203 on Brightness of Paper

Effect of PVOH 24-203 percentage solids on paper brightness

Effect of PVOH 24-203 percentage solids on paper whiteness

Blankophor and Optiblanc Performance Comparison

Effect of Surface Addition of OBA and PVOH Ratio on Brightness of Paper

Effect of Surface Addition of OBA and PVOH Ratio on Whiteness of Paper

Effect of Pulp pH on Brightness

Effect of Pulp pH on Whiteness

Effect of OBA and PVOH Brightness

PROCESS FOR IMPROVING OPTICAL PROPERTIES OF PAPER

This application is a national stage filing under 35 U.S.C. §371 of PCT/US2008/059250, filed Apr. 3, 2008, which claims priority to U.S. Provisional Patent Application No. 60/922,057, filed on Apr. 5, 2007, and U.S. Provisional Patent Application No. 61/032,588, filed on Feb. 29, 2008, the contents of which are incorporated herein by reference in their entirety.

FIELD OF THE INVENTION

The field of the invention relates to paper making processes for improving brightness and whiteness of the paper. More particularly, it relates to processes for maintaining or increasing brightness and whiteness of paper made from pulp subject to increased refining.

BACKGROUND OF THE INVENTION

Paper companies are continually seeking to improve the brightness and whiteness of their paper grades, especially printing and communication papers. The most common way of improving brightness at present is by increasing the amount of optical brightening agents (OBA's) or fluorescent brightener/whitener agents (FWA's) either at the wet end or at the size press. In many cases, this requires adding significantly high amounts of OBA's. However, there are drawbacks to adding large amounts of OBA's, such as the effect on the white water (recycle water) and changes to the paper making system charges. Also, the cost and availability of OBA's is a concern, since OBA's are not only expensive, but in great demand and supply is limited.

Paper mills tend to follow a general procedure rather than a customized procedure for chemical addition, often resulting in the mills using too much OBA as their main means of improving the brightness and whiteness of the paper. Moreover, in order to compete with new paper grades having increased brightness and/or whiteness, paper mills generally believe that the only way to improve brightness and whiteness is to keep increasing the OBA levels. Therefore, there is a need to find alternative ways of increasing the brightness and whiteness, without increasing, and preferably even reducing, the amount of OBA being used.

The paper making process involves many variables that can affect the optical quality of the final paper. The selection of the species of the tree(s) will have a tremendous impact on the final paper grade, including the ultimate brightness and whiteness. It is well known that increased pulp refining operations causes brightness loss in the pulp. However, refining is needed among other things to increase paper strength, fiber to fiber bond, increase smoothness, and improve formation. Fine paper mills refine to a greater degree to obtain properties such as opacity, porosity and strength. Some mills have to refine to a certain freeness to meet key operating parameters and have very little room for change. Pulp brightness also affects the final paper brightness, i.e., the brighter the pulp the brighter the paper. Therefore, losing pulp brightness due to refining has a serious impact on the final paper brightness.

In EP 1 378 545 A1, a specific aqueous liquid composition of a hexasulfonate fluorescent brightening agent is disclosed. It is further disclosed that the liquid composition can be added either internally to the pulp or, alternatively, externally in the size press coating. However, there is no teaching or suggestion of how to obtain high brightness and whiteness for highly refined pulp or of using other optical brightening agents or specific ratios or sequences of either wet end or size press additives to achieve high brightness or whiteness with such highly refined pulp.

EP 1 086 825 A1 is directed to an ink jet recording paper which is coated with a coating solution containing a fluorescent brightening agent, a water-soluble binder and a cationic polymer fixing agent. However, there is no teaching or suggestion of how to obtain high brightness and whiteness for highly refined pulp or of using specific ratios or sequences of either wet end or size press additives to achieve high brightness or whiteness with such highly refined pulp.

Despite considerable efforts which have been applied with the available products to solve the problem, there still exists a need to preserve brightness and whiteness during refining and to increase the brightness and whiteness of paper in a most efficient manner without increasing the OBA usage level.

SUMMARY OF THE INVENTION

The present invention is directed to a method of efficiently increasing brightness and whiteness of paper. This invention relates to increasing brightness and whiteness with optimized chemical addition, and maintaining brightness and whiteness during refining.

In a first aspect, the invention is directed to a method for substantially maintaining (or even increasing) brightness and/or whiteness of paper with increased pulp refining, the method including refining the pulp down to reduce the freeness at least about 100 CSF and adding a combination of an OBA and a carrier polymer to the paper surface in the size press in amounts sufficient to increase brightness and/or whiteness of the final paper.

The polymeric carrier is preferably polyvinyl alcohol (PVOH). The weight ratio of PVOH:OBA is preferably in the range of from about 1:1 to about 16:1., more preferably about 1.5:1 to about 12:1, and most preferably about 2:1 to about 8:1.

The pulp is preferably refined down to a predetermined freeness. In one embodiment, the freeness level corresponds with an increase in brightness and/or whiteness compared to a higher freeness level. Preferably, the pulp is refined to a freeness that substantially corresponds with the fiber delamination point.

The OBA and PVOH are preferably premixed before adding to the size press. The OBA is preferably added in an amount in a range from about 0.5 to about 15 lbs/ton (0.25 to 7.5 kg/metric ton (MT)) pulp, more preferably about 5 to about 14 lbs/ton (2.5 to 7 kg/MT) pulp, and, most preferably from about 8 to about 12 lbs/ton (4 to 6 kg/MT) pulp. The PVOH is preferably added in an amount in a range from about 50 to about 150 wet lbs/ton (25 to 75 kg/MT) pulp, more preferably about 70 to about 130 lbs/ton (35 to 65 kg/MT) pulp, and, most preferably from about 80 to about 120 lbs/ton (40 to 60 kg/MT) pulp. In a second aspect, the invention is directed to a method for substantially maintaining (or even increasing) brightness and/or whiteness of paper with increased pulp refining. Thus, the invention is directed to a method of making paper from refined pulp that includes refining a cellulosic fiber suspension to reduce the freeness at least about 100 CSF and contacting the cellulosic fibers with at least one optical brightening agent (OBA) during or after the refining step prior to adding any additional wet end chemicals. Preferably, the refining reduces the freeness by an amount between about 100 to about 400 CSF, more preferably about 150 to about 350 CSF, most preferably about 200 to about 325 CSF.

In one embodiment, the method includes refining the pulp down to a predetermined freeness, adding an OBA to the pulp in the wet end of the paper making process and adding to the pulp in the wet end of the paper making process one or more wet end additives selected from the group consisting of dye, precipitated calcium carbonate (PCC) and alkenyl succinic anhydride (ASA); wherein the OBA is added prior to the wet end additives and wherein the OBA and wet end additives are added in amounts sufficient to increase brightness and/or whiteness at the predetermined freeness level. Preferably, the pulp is a bleached pulp. Preferably the PCC and/or dye is added to the wet end after the OBA and prior to any additional wet end chemicals.

In one embodiment, all of the above listed wet end additives are added to the wet end of the paper making process. Preferably, the dye and PCC are added prior to the ASA. Preferably, the ASA is premixed with starch prior to adding to the wet end. Preferably, the starch is a potato starch. The ASA and starch are preferably mixed in a weight ratio of about 1:1 to about 1:5, more preferably about 1:2 to about 1:4 and most preferably about 1:3 to about 1:4.

In another embodiment, the method further includes adding to the wet end of the paper making process an additional wet end additive selected from the group consisting of an anionic polymer (PL), silica nanoparticles (NP) and a combination of both. Preferably, the additional wet end additive(s) is/are added after addition of the other wet end additives listed above, in the form of a retention system. The nanoparticles (NP) are preferably in the form of a microgel or at least partially aggregated nano-particle anionic silica sol. In one preferred embodiment, the wet end additives are added after the OBA in the following sequence: PCC, dye, ASA and PL. In another preferred embodiment, the wet end additives are added after the OBA in the following sequence: dye, PCC, ASA, PL and NP. In yet another preferred embodiment, the wet end additives are added after the OBA in the following sequence: PCC, dye, ASA, PL and NP. Preferably, in each of the preferred sequences, the ASA is premixed with starch prior to addition. Preferably, the starch is potato starch.

The OBA is preferably added to the wet end in an amount in a range from about 5 to about 35 lbs/ton (2.5 to 17.5 kg/MT) pulp, more preferably about 10 to about 30 lbs/ton (5 to 15 kg/MT) pulp, and, most preferably from about 15 to about 25 lbs/ton (7.5 to 12.5 kg/MT) pulp. The dye is preferably added in an amount in a range from about 0.01 to about 0.25 lbs/ton (0.005 to 0.125 kg/MT) pulp, more preferably about 0.02 to about 0.2 lbs/ton (0.01 to 0.1 kg/MT) pulp, and, most preferably from about 0.05 to about 0.15 lbs/ton (0.025 to 0.075 kg/MT) pulp. The PCC is preferably added in an amount in a range from about 100 to about 600 lbs/ton (50 to 300 kg/MT) pulp, more preferably about 300 to about 500 lbs/ton (150 to 250 kg/MT) pulp, and, most preferably from about 350 to about 450 lbs/ton (175 to 225 kg/MT) pulp.

The ASA is preferably added in an amount in a range from about 0.5 to about 4 lbs/ton (0.25 to 4 kg/MT) pulp, more preferably about 1 to about 3 lbs/ton (0.5 to 1.5 kg/MT) pulp, and, most preferably from about 1.5 to about 2.5 lbs/ton (0.75 to 1.25 kg/MT) pulp. In the embodiment where the ASA is premixed with starch, the ASA/starch mixture is preferably added in an amount in a range from about 2 to about 14 lbs/ton (1 to 7 kg/MT) pulp, more preferably about 4 to about 12 lbs/ton (2 to 6 kg/MT) pulp, and, most preferably from about 6 to about 10 lbs/ton (3 to 5 kg/MT) pulp.

In an embodiment where PL and/or NP is added to the wet end, the PL is preferably added in an amount in a range from about 0.1 to about 2.5 lbs/ton (0.05 to 1.25 kg/MT) pulp, more preferably about 0.3 to about 2 lbs/ton (0.15 to 1 kg/MT) pulp, and, most preferably from about 0.5 to about 1.5 lbs/ton (0.25 to 0.75 kg/MT) pulp. The NP is preferably added in an amount in a range from about 0.1 to about 2.5 lbs/ton (0.05 to 1.25 kg/MT) pulp, more preferably about 0.3 to about 2 lbs/ton (0.15 to 1 kg/MT) pulp, and, most preferably from about 0.5 to about 1.5 lbs/ton (0.25 to 0.75 kg/MT) pulp.

In a preferred embodiment, in addition to adding the OBA and wet end additives as discussed above, the method further includes the step of adding a combination of an OBA and PVOH to the paper surface in the size press in amounts sufficient to increase brightness and/or whiteness of the final paper, as discussed above.

Additional objects, advantages and novel features will be apparent to those skilled in the art upon examination of the description that follows.

DETAILED DESCRIPTION OF THE INVENTION

Figure 1:
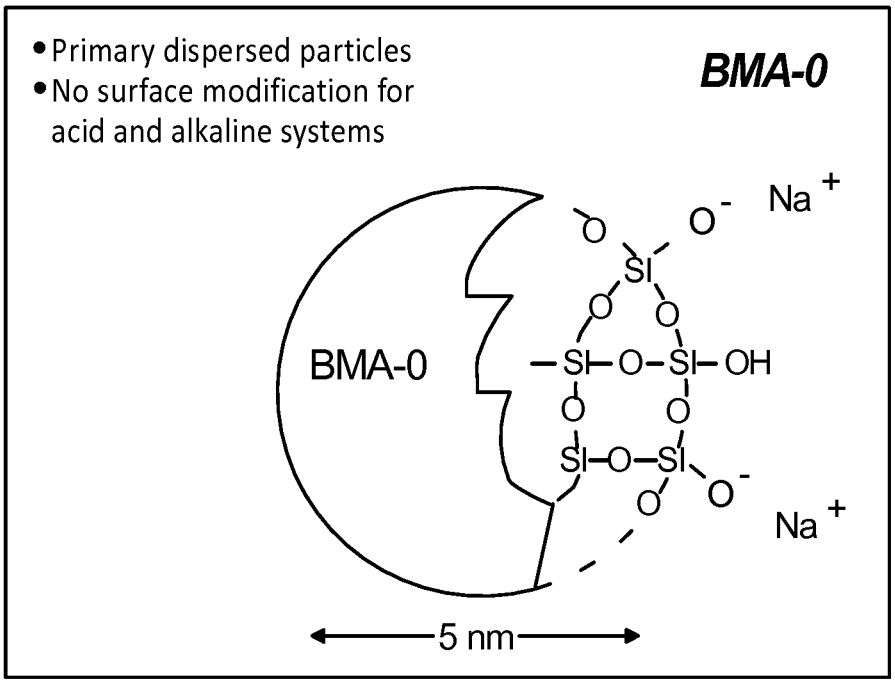
FIG. 1 is an illustration of a first generation nanoparticle BMA-0.

The present invention is directed to a method of efficiently maintaining, and preferably increasing, brightness and whiteness of paper with increased refining.

In one aspect, the invention includes contacting the cellulosic fibers in the pulp with at least one optical brightening agent (OBA) during or after the refining step prior to adding any additional wet end chemicals. In one embodiment, the OBA is contacted with the fibers after the refining step in the wet end.

OBA's used in the process of this invention may vary widely and any conventional OBA used or which can be used to brighten mechanical or Kraft pulp can be used in the conduct of the process of this invention. Optical brighteners are dye-like fluorescent compounds which absorb the short-wave ultraviolet light not visible to the human eye and emit it as longer-wave blue light, with the result that the human eye perceives a higher degree of whiteness and the degree of whiteness is thus increased. This provides added brightness and can offset the natural yellow cast of a substrate such as paper. Optical brighteners used in the present invention may vary widely and any suitable optical brightener may be used. An overview of such brighteners is to be found, for example, in Ullmann's Encyclopedia of Industrial Chemistry, Sixth Edition, 2000 Electronic Release, OPTICAL BRIGHTENERS—Chemistry of Technical Products which is hereby incorporated, in its entirety, herein by reference. Other useful optical brighteners are described in U.S. Pat. Nos. 5,902,454; 6,723,846; 6,890,454; 5,482,514; 6,893,473; 6,723,846; 6,890,454; 6,426,382; 4,169,810; and 5,902,454 and references cited therein which are all incorporated by reference. Still other useful optical brighteners are described in; and U.S. Pat. Application Publication Nos. US 2004/014910 and US 2003/0013628; and WO 96/00221 and references cited therein which are all incorporated by reference. Illustrative of useful optical brighteners are 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl)derivatives, bis-(benzimidazol-2-yl)derivatives, coumarins, pyrazolines, naphthalimides, triazinyl-pyrenes, 2-styryl-benzoxazole or -naphthoxazoles, benzimidazole-benzofurans or oxanilides.

Most commercially available optical brightening agents are based on stilbene, coumarin and pyrazoline chemistries and these are preferred for use in the practice of this invention. More preferred optical brighteners for use in the practice of this invention are optical brighteners typically used in the paper industry based on stilbene chemistry such as 1,3,5-triazinyl derivatives of 4,4'-diaminostilbene-2,2'-disulfonic acid and salts thereof, which may carry additional sulfo groups, as for example at the 2, 4 and/or 6 positions. Most preferred are the commercially available stilbene derivatives as for example those commercially available from Ciba Geigy under the tradename "Tinopal", from Clariant under the tradename "Leucophor", from Lanxess under the tradename "Blankophor", and from 3V under the tradename "Optiblanc" such as disulfonate, tetrasulfonate and hexasulfonate stilbene based optical brightening agents. Of these most preferred commercial optical brightening agents, the commercially available disulfonate and tetra sulfonate stilbene based optical brightening agents are more preferred and the commercially available disulfonate stilbene based optical brightening agents is most preferred. While the present invention prefers methods and fiber-OBA complexes using the above-mentioned OBA, the present invention is in no way limited to such exemplified embodiments and any OBA may be utilized.

In another embodiment, the method includes adding filler and/or dye in the wet end after the OBA and prior to any additional wet end chemicals. Suitable mineral fillers of conventional types may be added to the aqueous cellulosic suspension according to the invention. Examples of suitable fillers include kaolin, china clay, titanium dioxide, gypsum, talc and natural and synthetic calcium carbonates such as chalk, ground marble and precipitated calcium carbonate (PCC). The preferred filler is PCC. Any dyes conventionally used in the wet end chemistry in paper making can be used. In one preferred embodiment the dye, Premier Blue 2GS-MT, commercially available from Royal Pigments, can be used.

In yet another embodiment, a retention system is added to the wet end after adding the PCC and/or dye, wherein the retention system includes an anionic polymer and a microgel or at least partially aggregated nano-particle anionic silica sol. Depending on the charge and the need to balance charges of the pulp, it may be advisable to add a cationic polymer and/or size agent prior to adding the retention system. In one embodiment a combination of ASA and cationic potato starch is added prior to the retention system.

The retention system can include any of several kinds of anionic polymers used as drainage and retention aides, for example, anionic organic polymers. Anionic organic polymers that can be used according to the invention can contain one or more negatively charged (anionic) groups. Examples of groups that can be present in the polymer as well as in the monomers used for preparing the polymer include groups carrying an anionic charge and acid groups carrying an anionic charge when dissolved or dispersed in water, the groups herein collectively being referred to as anionic groups, such as phosphate, phosphonate, sulphate, sulphonic acid, sulphonate, carboxylic acid, carboxylate, alkoxide and phenolic groups, i.e. hydroxy-substituted phenyls and naphthyls. Groups carrying an anionic charge are usually salts of an alkali metal, alkaline earth or ammonia.

Anionic organic particles that can be used according to the invention include cross-linked anionic vinyl addition polymers, suitably copolymers comprising an anionic monomer like acrylic acid, methacrylic acid and sulfonated or phosphonated vinyl addition monomers, usually copolymerised with non-ionic monomers like (meth)acrylamide, alkyl (meth)-acrylates, etc. Useful anionic organic particles also include anionic condensation polymers, e.g. melamine-sulfonic acid sols.

Further anionic polymers that can form part of the drainage and retention system include vinyl addition polymers comprising an anionic monomer having carboxylate groups like acrylic acid, methacrylic acid ethylacrylic acid, crotonic acid, itaconic acid, maleic acid and salts of any of the foregoing, anhydrides of the diacids, and sulfonated vinyl addition monomers, such as sulfonated styrene, usually copolymerised with non-ionic monomers like acrylamide, alkyl acrylates, etc., for example those disclosed in U.S. Pat. Nos. 5,098,520 and 5,185,062, the teachings of which are hereby incorporated herein by reference. The anionic vinyl addition polymers suitably have weight average molecular weights from about 50,000 to about 5,000,000, typically from about 75,000 to about 1,250,000.

Examples of suitable anionic organic polymer further include step-growth polymers, chain-growth polymers, polysaccharides, naturally occurring aromatic polymers and modifications thereof. The term "step-growth polymer", as used herein, refers to a polymer obtained by step-growth polymerisation, also being referred to as step-reaction polymer and step-reaction polymerisation, respectively. The anionic organic polymers can be linear, branched or cross-linked. Preferably the anionic polymer is water-soluble or water-dispersable. In one embodiment, the anionic organic polymer can contain one or more aromatic groups.

Anionic organic polymers having aromatic groups can contain one or more aromatic groups of the same or different types. The aromatic group of the anionic polymer can be present in the polymer backbone or in a substituent group that is attached to the polymer backbone (main chain). Examples of suitable aromatic groups include aryl, aralkyl and alkaryl groups and derivatives thereof, e.g. phenyl, tolyl, naphthyl, phenylene, xylylene, benzyl, phenylethyl and derivatives of these groups.

Examples of suitable anionic aromatic step-growth polymers include condensation polymers, i.e. polymers obtained by step-growth condensation polymerisation, e.g. condensates of an aldehyde such as formaldehyde with one or more aromatic compounds containing one or more anionic groups, and optional other co-monomers useful in the condensation polymerisation such as urea and melamine. Examples of suitable aromatic compounds containing anionic groups comprises benzene and naphthalene-based compounds containing anionic groups such as phenolic and naphtholic compounds, e.g. phenol, naphthol, resorcinol and derivatives thereof, aromatic acids and salts thereof, e.g. phenylic, phenolic, naphthylic and naphtholic acids and salts, usually sulphonic acids and sulphonates, e.g. benzene sulphonic acid and sulphonate, xylen sulphonic acid and sulphonates, naphthalene sulphonic acid and sulphonate, phenol sulphonic acid and sulphonate. Examples of suitable anionic step-growth polymers according to the invention include anionic benzene-based and naphthalene-based condensation polymers, preferably naphthalene-sulphonic acid based and naphthalene-sulphonate based condensation polymers.

Examples of further suitable anionic step-growth polymers having aromatic groups include addition polymers, i.e. polymers obtained by step-growth addition polymerisation, e.g. anionic polyurethanes, which can be prepared from a monomer mixture comprising aromatic isocyanates and/or aromatic alcohols. Examples of suitable aromatic isocyanates include diisocyanates, e.g. toluene-2,4- and 2,6-diisocyanates and diphenylmethane-4,4'-diisocyanate. Examples of suitable aromatic alcohols include dihydric alcohols, i.e. diols, e.g. bisphenol A, phenyl diethanol amine, glycerol monoterephthalate and trimethylolpropane monoterephthalate. Monohydric aromatic alcohols such as phenol and derivatives thereof may also be employed. The monomer mixture can also contain non-aromatic isocyanates and/or alcohols, usually diisocyanates and diols, for example any of those known to be useful in the preparation of polyurethanes. Examples of suitable monomers containing anionic groups include the monoester reaction products of triols, e.g. trimethylolethane, tri-methylolpropane and glycerol, with dicarboxylic acids or anhydrides thereof, e.g. succinic acid and anhydride, terephthalic acid and anhydride, such as glycerol monosuccinate, glycerol monoterephthalate, trimethylolpropane monosuccinate, trimethylolpropane monoterephthalate, N,N-bis-(hydroxyethyl)-glycine, di-(hydroxymethyl)propionic acid, N,N-bis-(hydroxyethyl)-2-aminoethanesulphonic acid, and the like, optionally and usually in combination with reaction with a base, such as alkali metal and alkaline earth hydroxides, e.g. sodium hydroxide, ammonia or an amine, e.g. triethylamine, thereby forming an alkali metal, alkaline earth or ammonium counter-ion.

Examples of suitable anionic chain-growth polymers having aromatic groups include anionic vinyl addition polymers obtained from a mixture of vinylic or ethylenically unsaturated monomers comprising at least one monomer having an aromatic group and at least one monomer having an anionic group, usually co-polymerised with non-ionic monomers such as acrylate- and acrylamide-based monomers. Examples of suitable anionic monomers include (meth)acrylic acid and paravinyl phenol (hydroxy styrene).

Examples of suitable anionic polysaccharides having aromatic groups include starches, guar gums, celluloses, chitins, chitosans, glycans, galactans, glucans, xanthan gums, pectins, mannans, dextrins, preferably starches, guar gums and cellulose derivatives, suitable starches including potato, corn, wheat, tapioca, rice, waxy maize and barley, preferably potato. The anionic groups in the polysaccharide can be native and/or introduced by chemical treatment. The aromatic groups in the polysaccharide can be introduced by chemical methods known in the art.

Naturally occurring aromatic anionic polymers and modifications thereof, i.e. modified naturally occurring aromatic anionic polymers, according to the invention include naturally occurring polyphenolic substances that are present in wood and organic extracts of bark of some wood species and chemical modifications thereof, usually sulphonated modifications thereof. The modified polymers can be obtained by chemical processes such as, for example, sulphite pulping and kraft pulping. Examples of suitable anionic polymers of this type include lignin-based polymers, preferably sulphonated lignins, e.g. ligno-sulphonates, kraft lignin, sulphonated kraft lignin, and tannin extracts.

The weight average molecular weight of the anionic polymer having aromatic groups can vary within wide limits dependent on, inter alia, the type of polymer used, and usually it is at least about 500, suitably above about 2,000 and preferably above about 5,000. The upper limit is not critical; it can be about 200,000,000, usually about 150,000,000, suitably about 100,000,000 and preferably about 10,000,000.

The anionic polymer having aromatic groups can have a degree of anionic substitution ($DS_A$) varying over a wide range dependent on, inter alia, the type of polymer used; $DS_A$ is usually from 0.01 to 2.0, suitably from 0.02 to 1.8 and preferably from 0.025 to 1.5; and the degree of aromatic substitution ($DS_Q$) can be from 0.001 to 1.0, usually from 0.01 to 0.8, suitably from 0.02 to 0.7 and preferably from 0.025 to 0.5. In case the anionic polymer contains cationic groups, the degree of cationic substitution ($DS_C$) can be, for example, from 0 to 0.2, suitably from 0 to 0.1 and preferably from 0 to 0.05, the anionic polymer having an overall anionic charge. Usually the anionic charge density of the anionic polymer is within the range of from 0.1 to 6.0 meqv/g of dry polymer, suitably from 0.5 to 5.0 and preferably from 1.0 to 4.0.

Examples of suitable aromatic, anionic organic polymers that can be used according to the present invention include those described in U.S. Pat. Nos. 4,070,236 and 5,755,930; and International Patent Application Publication Nos. WO 95/21295, WO 95/21296, WO 99/67310, WO 00/49227 and WO 02/12626, which are hereby incorporated herein by reference.

Further to the above mentioned cationic and anionic drainage and retention aids, low molecular weight cationic organic polymers and/or inorganic aluminium compounds can also be used as drainage and retention aids.

Low molecular weight (hereinafter called LMW) cationic organic polymers that can be used in conjunction with the dewatering and retention aid include those commonly referred to and used as anionic trash catchers (ATC). ATC's are known in the art as neutralising and/or fixing agents for disturbing/detrimental anionic substances present in the stock and the use thereof in combination with drainage and retention aids often provide further improved drainage and/or retention. The LMW cationic organic polymer can be derived from natural or synthetic sources, and preferably it is a LMW synthetic polymer. Suitable organic polymers of this type include LMW highly charged cationic organic polymers such as polyamines, polyamidoamines, polyethyleneimines, homo- and copolymers based on diallyldimethyl ammonium chloride, (meth)acrylamides and (meth)acrylates, vinylamide-based and polysaccarides. In relation to the molecular weight of the retention and dewatering polymers, the weight average molecular weight of the LMW cationic organic polymer is preferably lower; it is suitably at least about 2,000 and preferably at least about 10,000. The upper limit of the molecular weight is usually about 2,000,000, to about 3,000,000. Suitable LMW polymers may have a weight average molecular weight of from about 2,000 up to about 2,000,000.

Aluminium compounds that can be used as ATC's, according to the invention include alum, aluminates, aluminium chloride, aluminium nitrate and polyaluminium compounds, such as polyaluminium chlorides, polyaluminium sulphates, polyaluminium compounds containing both chloride and sulphate ions, polyaluminium silicate-sulphates, and mixtures thereof. The polyaluminium compounds may also contain other anions than chloride ions, for example anions from sulfuric acid, phosphoric acid, and organic acids such as citric acid and oxalic acid.

Preferred anionic polymers include anionic polymers commercially available from Eka Chemicals, under the PL designation, for example PL 1610, PL 1710 and PL 8430. Additionally, cationic polymers from Eka Chemicals can also be used in the present invention, for example, PL 2510.

In one preferred embodiment, the retention system includes anionic silica-based particles. Examples of suitable anionic silica-based particles include those having an average particle size below about 100 nm, for example below about 20 nm or in the range of from about 1 to about 10 nm. Preferably the average particle size is from about 1 to about 5 nm. As conventional in the silica chemistry, the particle size refers to the average size of the primary particles, which may be aggregated or non-aggregated. According to one embodiment, the anionic silica-based particles are aggregated anionic silica-based particles. The specific surface area of the silica-based particles is suitably at least 50 $m^2/g$, for example at least 100 $m^2/g$. Generally, the specific surface area can be up to about 1700 $m^2/g$, suitably up to about 1000 $m^2/g$. The specific surface area is measured by means of titration with NaOH as described by G. W. Sears in Analytical Chemistry 28 (1956): 12, 1981-1983 and in U.S. Pat. No. 5,176,891 after appropriate removal of or adjustment for any compounds present in the sample that may disturb the titration like aluminium and boron species. The given area thus represents the average specific surface area of the particles.

In one embodiment of the invention, the anionic silica-based particles have a specific surface area within the range of from 50 to 1000 $m^2/g$, for example from 100 to 950 $m^2/g$. The silica-based particles may be present in a sol having a S-value in the range of from 8 to 50%, for example from 10 to 40%, containing silica-based particles with a specific surface area in the range of from 300 to 1000 $m^2/g$, suitably from 500 to 950 $m^2/g$, for example from 750 to 950 $m^2/g$, which sols can be modified as mentioned above. The S-value is measured and calculated as described by Iler & Dalton in J. Phys. Chem. 60 (1956), 955-957. The S-value indicates the degree of aggregation or microgel formation and a lower S-value is indicative of a higher degree of aggregation.

In yet another embodiment of the invention, the silica-based particles have a high specific surface area, suitably above about 1000 $m^2/g$. The specific surface area can be in the range of from 1000 to 1700 $m^2/g$, for example from 1050 to 1600 $m^2/g$.

Preferred silica-based particles that can be used in the method according to the invention include silica-based particles available from Eka Chemicals, under the NP designation, for example NP 320 and NP 442.

EXAMPLES

The materials, equipment and test methods and materials used in the examples are described below:

Materials

Kraft pulp was obtained from a Southern U.S. mill. The pulp was from the D1 and D2 bleaching stages. The D2 stage hardwood (HW) and softwood (SW) pulp samples were bleached to a higher brightness level by addition of a peroxide (P) stage (D0-Eop-D1-D2-P). The pulps were refined separately in a Valley Beater. Pulp refining freeness levels (CSF) are shown in table I, along with the freeness for the 60% hardwood/40% softwood pulp mixture after refining.

TABLE I

Pulp Freeness Before and After Refining for three Bleaching Stages and 60% HW/40% SW Ratio

| Sample ID | Freeness (CSF) |
|---|---|
| Pulp ISO Brightness Prior to Refining | |
| HW D1 | 625 |
| HW D2 | 550 |
| HW P | 625 |
| Pulp ISO Brightness After Refining | |
| HW D1 | 300 |
| HW D2 | 310 |
| HW P | 295 |
| Pulp ISO Brightness after refining and mixing | |
| D1 60% HW | 345 |
| D2 60% HW | 350 |
| P 60% HW | 350 |

The chemicals used to make the different sets of handsheets include filler, size, cationic starch, silica sol retention aids, ionic polymers, optical brightening agents, carriers, and dyes.

Equipment and Test Methods

The instruments, equipment, and test methods used to make the handsheets and to measure the desired properties are as follows:

The equipment used were: 1) valley beater to refine the pulp, 2) handsheet moulds to make the handsheets, 3) wet press and drum dyers to dry the handsheets, 4) automated draw down table to coat the handsheets, 5) Technidyne brightness meter to test for brightness, whiteness, scattering and absorption coefficients. 6) DDA tester to measure turbidity and drainage.

Brightness D65 Test Method was performed with the Technidyne according to ISO 2470:1999. Calibration of UV content is described in ISO 11475:2002 and whiteness CIE/10° according to ISO 1475:2002

The test methods used to measure freeness of the refined and unrefined pulp was the Canadian Standard of Freeness Test (TAPPI method T227).

Nanotechnology

Figure 2:
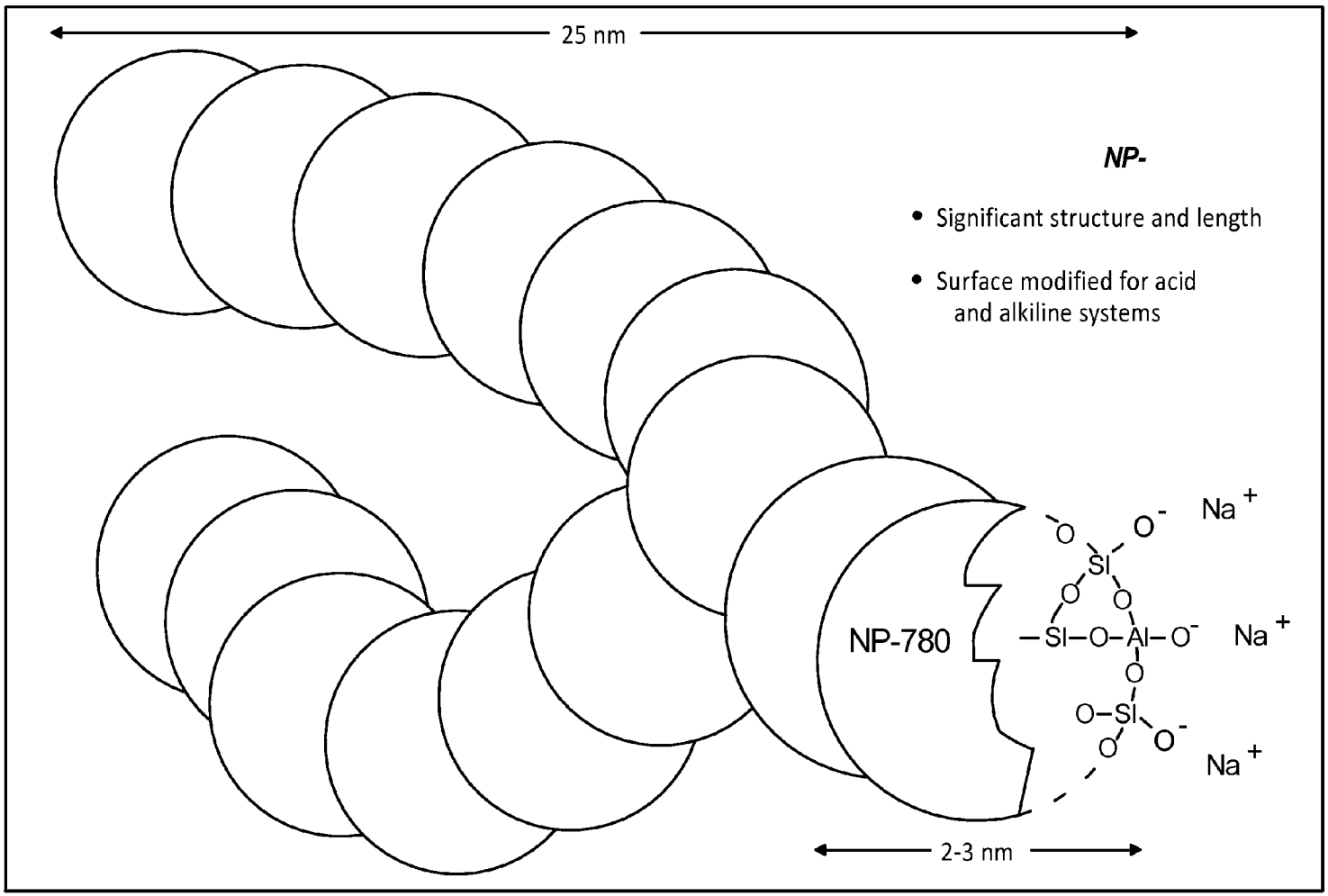
FIG. 2 is an illustration of a third generation nanoparticle NP.

Two nanoparticle technologies were used. One consists of an anionic colloidal silica sol particle manufactured by Eka Chemicals (NP) third generation and the other is the existing first generation technology (BMA-0). NP nanoparticle is smaller in size, has a modified surface suitable for acid and alkaline systems, and is capable to form long chains of up to about 25 nm. The primary silica particles are non porous and spherical, they have surface areas ranging from 500-3,000 $m^2/g$ while the surface area of swollen wood fibers is about 200 $m^2/g$. The surface of the silica is acidic and protons disassociate from silanol groups. The differences between the BMA-0 and NP particles are illustrated in FIGS. 1 and 2.

Comparative Example 1

Experiments were conducted to evaluate the effect of refining on certain paper properties. Softwood and hardwood pulps, respectively, were collected from the D2 bleaching stage of a paper mill (i.e., the second $ClO_2$ bleaching stage). Some of the pulp was left unrefined and a portion of the pulp was refined in the Valley Beater to varying degrees of freeness. The softwood and hardwood pulps were refined to 380 CSF and 340 CSF respectively. Brightness pads (5 gm) were made with the unrefined and refined pulp and measured with the Technidyne Color Lab, similarly handsheets (1.6 gm) were made with both pulps to assess the brightness loss due to refining.

Figure 3:
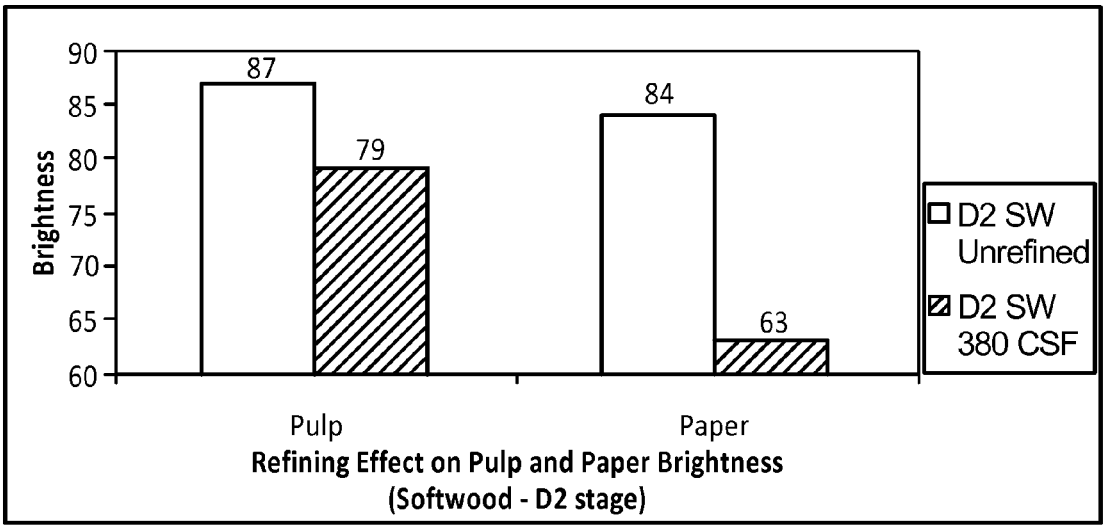
FIG. 3 is a graph showing the effect of refining on softwood pulp and paper brightness.
Figure 4:
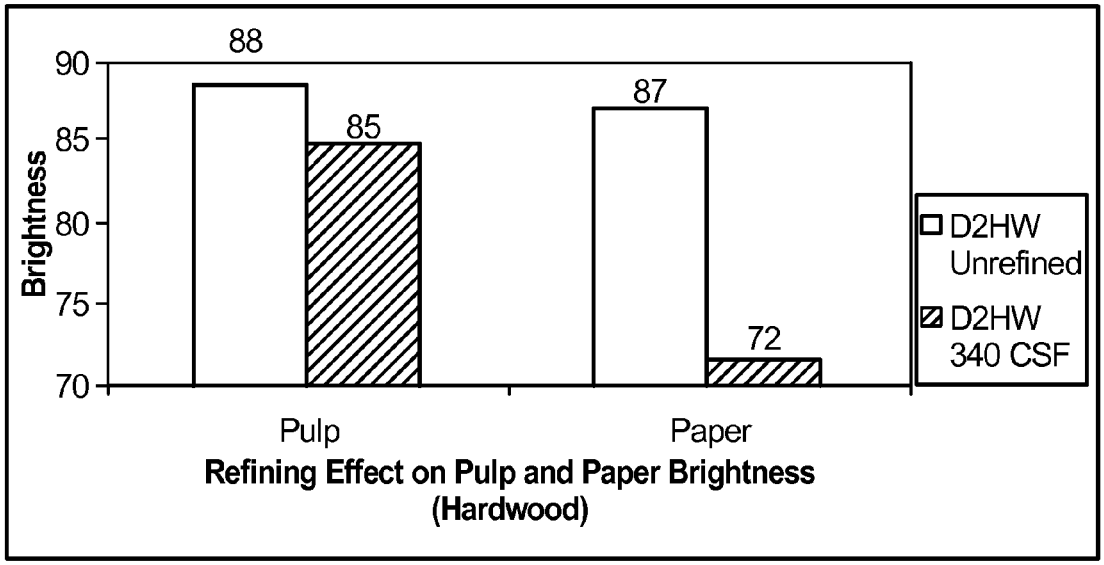
FIG. 4 is a graph showing the effect of refining on hardwood pulp and paper brightness.
Figure 5:
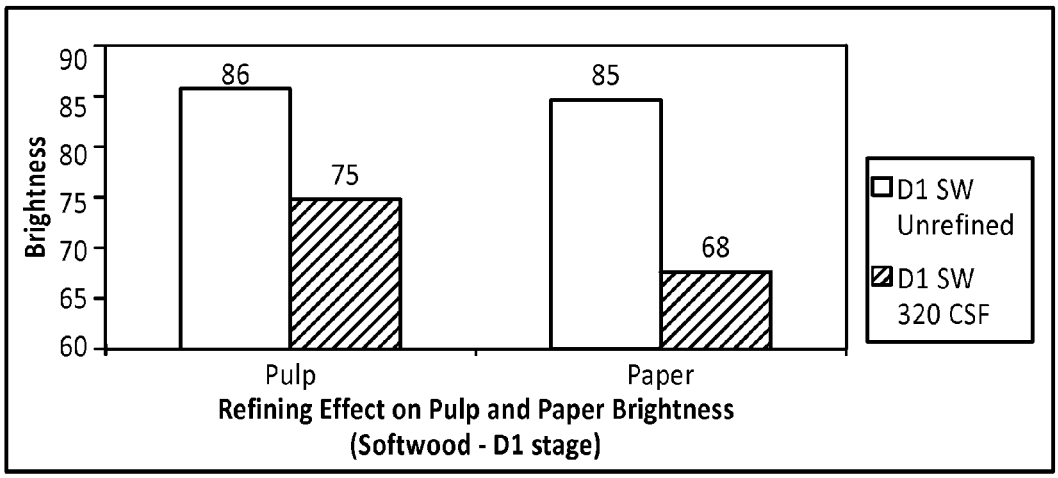
FIG. 5 is a graph showing the effect of refining on softwood pulp and paper brightness.

FIGS. 3 and 4 show the effect refining has on pulp and paper brightness. In FIG. 3, the softwood pulp decreased its brightness by 9% after refining, but the paper decrease was more significant at 25% decrease in brightness. In FIG. 4, hardwood pulp brightness decreased by 3.4% while the paper decreased its brightness after refining by 17%. These two figures illustrate the difference in the loss not only between hardwoods and softwoods, but most importantly it shows that paper looses more brightness due to refining the pulp. Whiteness followed a similar trend to the brightness, i.e., decreases in whiteness were also observed due to refining. Pulp from the D1 bleaching stage (i.e., the first $ClO_2$ bleaching stage) showed the same trend, as can be seen in FIG. 5.

Example 1

Experiments were conducted to determine the effect that pulp ratio (HW to SW), optical brightening agent, pulp pH, and refining have on brightness and/or whiteness. Pulp from the D1 bleaching stage was refined to 5 different refining freeness levels to evaluate the effect refining has on brightness. Three different pulp ratios were evaluated 100% hardwood (100% HW), 60% hardwood mixed with 40% softwood (60% HW); and 100% softwood pulp (0% HW). Two pH levels were tested and the pH of the refined pulp was adjusted to 5.5 and 7. The optical brightening agent (OBA) used was Optiblanc disulfonate from 3V. The OBA for the surface was mixed with PVOH Celvol 24-203 diluted to 8.3% solids to act as a functioning bearer. Some conditions had no OBA, some had 20#/ton at the wet end (WE), other had 10#/ton at the size press (SP), and some had a combination of both wet end and surface OBA (WE & SP).

Figure 6:
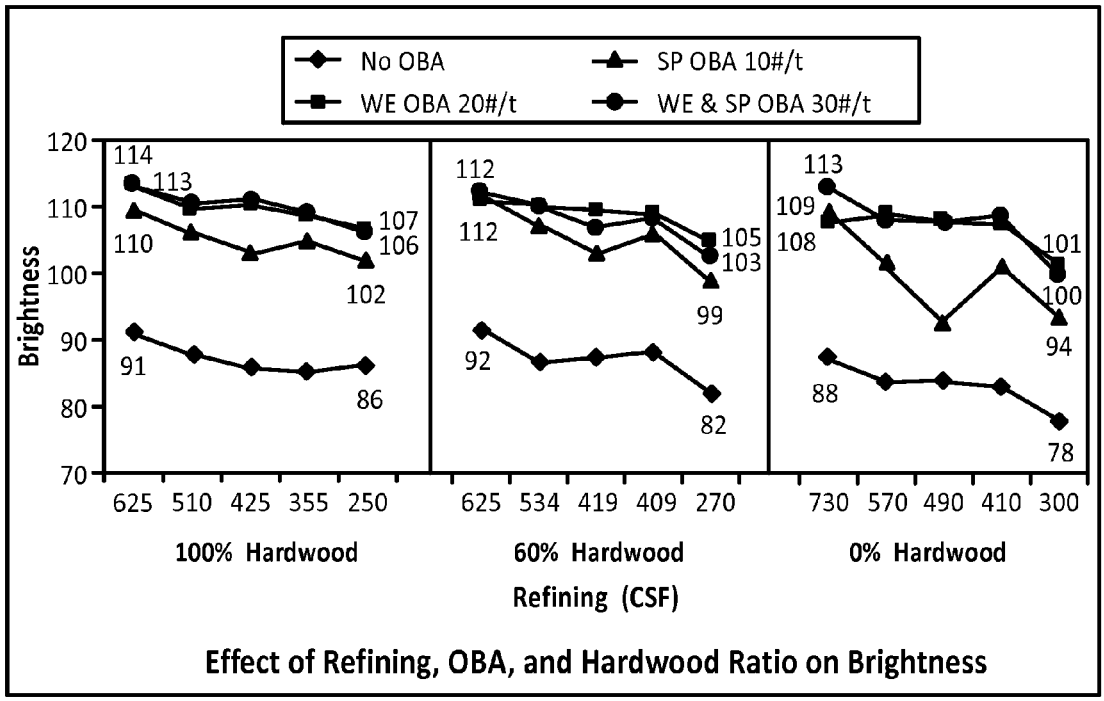
FIG. 6 is a graph showing the effect of refining, OBA addition and hardwood ratio on paper brightness.

For these experiments the unrefined hardwood had a freeness of 625 CSF and the softwood 730 CSF. The hardwood pulp was refined at 1.5% consistency to 510, 425, 355, and 250 CSF and the softwood pulp was refined to 570, 490, 410, 300 CSF. The refined pulp was mixed to 60% hardwood with 40% softwood. Handsheets were made from the pulp and OBA was added either at the wet end or the size press. No other chemicals were added to the handsheets to observe the interaction of the OBA with the fibers. A review of FIGS. 5 and 6 shows the effect of refining on the pulp without any OBA (base sheet). For the handsheets made with 20 lb/ton (10 kg/MT) of OBA, the addition was made directly to the refined pulp and before the handsheets were made to simulate wet end addition of OBA. For the handsheets made with 10 #/ton (5 kg/MT) of OBA, the OBA was added on the surface with an automated draw down to simulate size press addition. Handsheets were also made with both wet end and size press addition of OBA.

Figure 7:
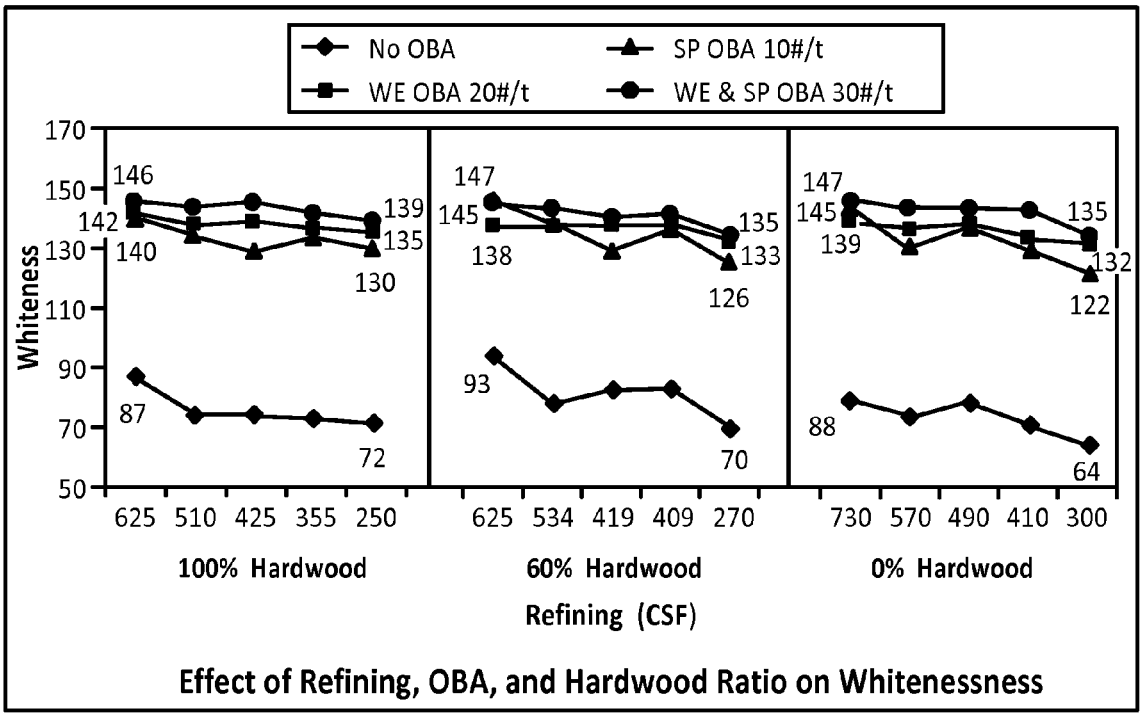
FIG. 7 is a graph showing the effect of refining, OBA addition and hardwood ratio on paper whiteness.

FIGS. 6 and 7 show the results of the effect that refining, OBA addition and pulp ratio have on brightness and whiteness. A review of FIG. 6 shows the following:

1. Refining decreases the brightness of the paper for all conditions whether they have OBA or not. There is a significant decrease in brightness as the CSF is reduced from the unrefined to the highly refined samples.
2. The handsheets made out of 100% softwood had a higher loss of brightness
3. 10 lb/ton of surface OBA increases the brightness significantly when compared to the base sheets.
4. 20#/ton (10 kg/MT) of wet end OBA has similar brightness than when additional 10 lb/ton (5 kg/MT) are added to the size press.
5. Softwood also has higher whiteness loss than hardwoods due to refining.

FIG. 7 shows a similar trend for the whiteness as for the brightness with h the difference that 10 lb/ton (5 kg/MT) of surface OBA gives similar whiteness as 20 lb/ton (10 kg/MT) of wet end OBA and 30 lb/ton (15 kg/MT) of combined OBA.

Figure 8:
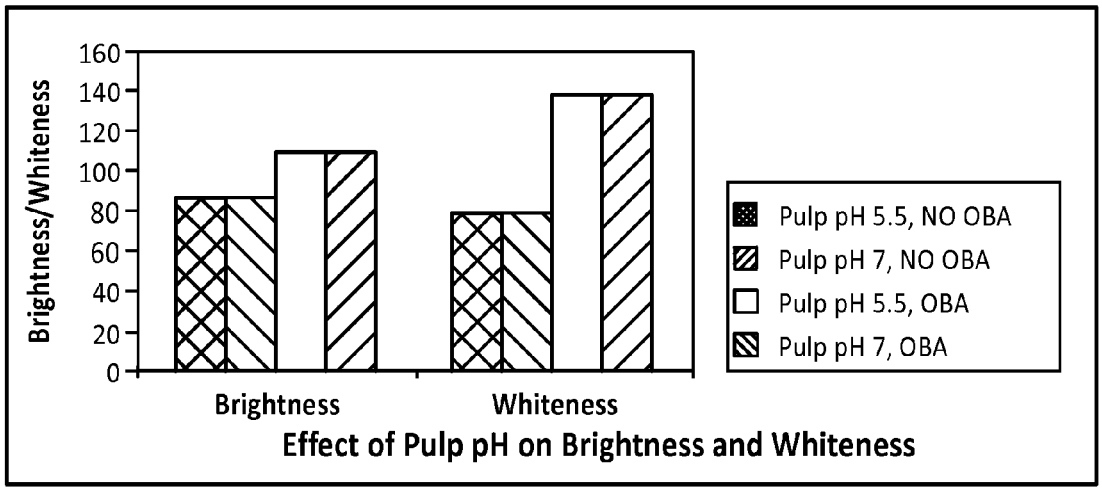
FIG. 8 is a graph showing the effect of pulp pH on brightness and whiteness.

A review of FIG. 8 reveals that the pH does not appear to have any effect on either brightness or whiteness of the paper.

Figure 9:
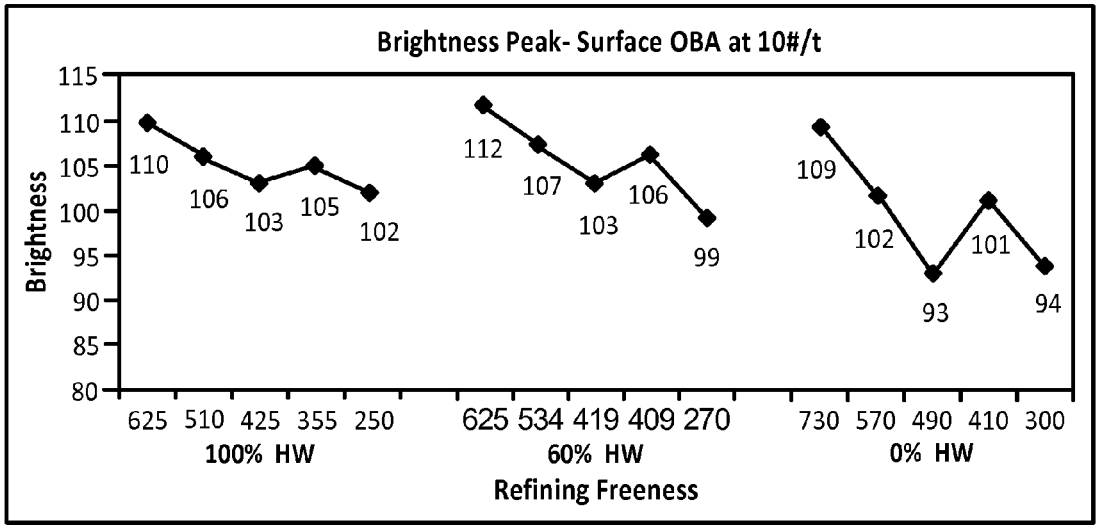
FIG. 9 is a graph showing the effect of refining on paper brightness for surface treated with an OBA.
Figure 10:
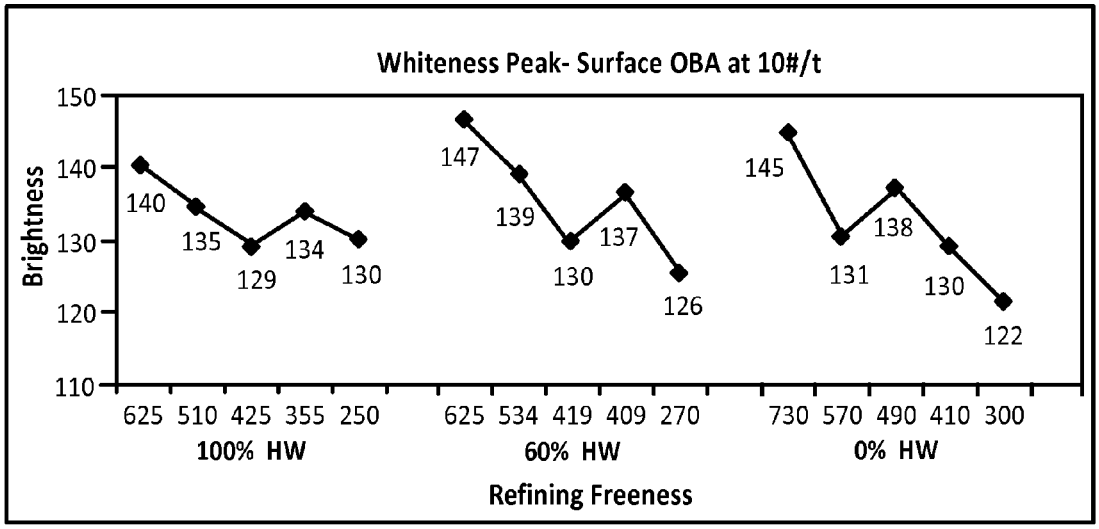
FIG. 10 is a graph showing the effect of refining on paper whiteness for surface treated with an OBA.

Adding 10 lb/ton (5 kg/MT) of the mixture of OBA with PVOH to the surface of the paper produces an unusual brightness and whiteness peak as can be seen in FIGS. 9 and 10. The peaks seem to be at around the fiber delamination point for hardwoods, softwoods, and the combination of both. For the 100% hardwood fibers the brightness and whiteness peak is at about 355 CSF; for the 100% softwood (0% HW) the brightness and whiteness peak is at about 410 CSF; and for the combined 60% hardwood and 40% softwood the peak is at about 409 CSF. This unexpected brightness boost means that it is possible to refine to a lower freeness (to improve the formation and smoothness of the paper which in turn improve printability of the paper) and still be able to have similar brightness as if the refining would have been 510 for 100% HW, 570 CSF for 100% softwood (0% HW) and 534 CSF for the 60/40 HW/SW mixture. The Figures further show that further refining beyond the peak point will result in a decrease of brightness and whiteness.

FIGS. 6 and 7 show that the control curves, for the samples with "No OBA", have a rather small peak, but when the OBA mixed with the PVOH carrier is added to the surface of the paper there is a sharp peak in the brightness and whiteness of the paper (as shown in FIGS. 9 and 10).

From this set of experiments it appears that as refining increases, the brightness and whiteness of the paper decreases, but there is a point in the refining where the brightness and whiteness increase. These observed peaks appear to occur at a refining level around the fiber delamination point.

Comparative Example 2

Over 800 commercially available uncoated white paper grades were tested for brightness and whiteness to determine their industry ranking and assess the industry brightness and whiteness levels. The results from the evaluation showed that the uncoated free sheet grades have the highest brightness and whiteness. The top 10 brightness and whiteness paper grades are summarized in Tables 1 and 2 below. From all the paper grades tested for the brightness and whiteness benchmark (excluding cover, coated, and LWC) the top 10 uncoated paper grades with the highest brightness and whiteness are shown in Tables 2 and 3. These data were evaluated to serve as target for the chemical addition sequence experiments.

TABLE 2

Top Ten Brightness Paper Grades

| Ranking | Source | Purpose/Grade name | Brightness (D65) |
|---|---|---|---|
| 1 | Xerox | Premium Laser | 116.84 |
| 2 | Weyerhaeuser | Cougar Text Vellum | 116.21 |
| 3 | Weyerhaeuser | Cougar Text Vellum | 116.21 |
| 4 | Weyerhaeuser | Cougar Text Vellum | 116.00 |
| 5 | Mohawk | Neon White | 115.70 |
| 6 | Weyerhaeuser | Cougar Text Smooth | 115.59 |
| 7 | Mohawk | Ultrawhite Smooth Text | 115.36 |
| 8 | Weyerhaeuser | Cougar Text Smooth | 115.29 |
| 9 | Kodak | Bright White | 115.08 |
| 10 | Mohawk | Ultrawhite Eggshell Text | 114.97 |

TABLE 3

Top Ten Whiteness Paper Grades

| Ranking | Source | Purpose/Grade name | CIE Whiteness |
|---|---|---|---|
| 1 | Xerox | Premium Laser | 170.64 |
| 2 | Data | M-real Data Copy | 164.69 |
| 3 | Kodak | Bright White | 163.71 |
| 4 | Epson | Bright White | 160.67 |
| 5 | Staples | Multiuse Paper Bright White | 159.71 |
| 6 | HP | Bright White Inkjet | 158.7 |
| 7 | Weyerhaeuser | Cougar Text Vellum | 158.21 |
| 8 | Weyerhaeuser | Cougar Text Vellum | 158.18 |
| 9 | Weyerhaeuser | Cougar Text Smooth | 158.14 |
| 10 | Weyerhaeuser | Cougar Text Smooth | 157.9 |

Brightness levels from lowest to highest for the 223 uncoated commercial white papers grades selected for this benchmark ranged from 103.48 to 116.84 in D65 brightness. Similarly, the range for the CIE Whiteness ranged from 90.54 to 170.64 units.

Example 2

Chemical Addition Sequence experiments: Several sets of experiments were conducted to try to optimize the brightness and whiteness of uncoated bleached paper. The main parameters considered to influence brightness and whiteness were:

1. pulp brightness,
2. selected chemicals (bleaching, wet end and surface),
3. optimized chemical dosages and chemical sequences to increase the brightness and whiteness of paper.

Hardwood and softwood pulp samples were obtained from the D2 bleaching stage of a paper mill. The hardwood (HW) and softwood (SW) from the D2 stage pulp samples were bleached to a higher brightness level by addition of a peroxide (P) stage (D0-Eop-D1-D2-P). The pulp obtained from the mill was subject to an initial $ClO_2$ stage, an extraction stage (including caustic, pressurized $O_2$ and peroxide treatment), and first and second $ClO_2$ stages. This pulp was then further bleached by addition of hydrogen peroxide. Pulp brightness and refining freeness (CSF) are shown in tables 4 and 5 respectively. SW-P pulp was used for experiments for 1 chemical to 3-chemical addition sequences. SW-D2 pulp was used for 4-chemical to all-chemical sequences. The SW-P had a pH of 7.07 and the SW-D2 had a pH of 5.63.

TABLE 4

Brightness levels achieved by bleaching

| Sample ID | | ISO brightness |
|---|---|---|
| D2 stage pulp from mill, | HW | 90.52 |
| D0/Eop/D1/D2 | SW | 89.95 |
| Bleached D2 stage pulp, | HW | 92.73 |
| D0/Eop/D1/D2/P | SW | 92.31 |

TABLE 5

Pulp freeness values before and after refining

| Sample ID | | CSF before refining | CSF after refining |
|---|---|---|---|
| D2 | HW | 550 | 355 |
| | SW | 730 | 490 |
| P | HW | 625 | 330 |
| | SW | 730 | 470 |

The chemicals used and their charges are shown in Table 6 below. The experiments consisted of adding the wet end chemicals one at the time to see the effect these had on the fiber. Table 7 gives a description of the OBA, dye and PVOH used for this set of experiments.

TABLE 6

Chemicals used for the chemical sequence experiments

| Chemicals | Experiments 1-Chem to 3-Chem Description |
|---|---|
| OBA Di | Optiblanc |
| OBA Tetra | Optiblanc |
| Dye | |
| ASA | |
| PL (Polymer) | 8430 |
| NP (silica) | 442 |
| ATC | 5432 |
| PCC | |

TABLE 7

Description of the OBA, Dye and PVOH used for the study

| Chemical | Product name | Company | Date/LOT# |
|---|---|---|---|
| OBA (wet end) | OPTIBLANC NL | 3V Inc. | 1505F36T |
| OBA (surface) | OPTIBLANC NF 2000 | 3V Inc. | 1505N240T |
| Dye | PREMIER BLUE 2GS-MT | Royal Pigments and Chemicals Inc. | Jun. 12, 2006 |
| PVOH | Cevol 24203, Polyvinyl alcohol solution | Celanese Chemicals | W040416639 |

The Chemicals in Table 6 were added to the fiber one at the time to simulate the wet end of the paper machine. Additional chemicals were added to the surface after the handsheets had been dried. Surface OBA and PVOH (Table 7) were added on the surface of the handsheets at a rate of 0.1 ml to 1 ml of OBA for 15 ml of PVOH @ 8.3% solids.

Figure 11:
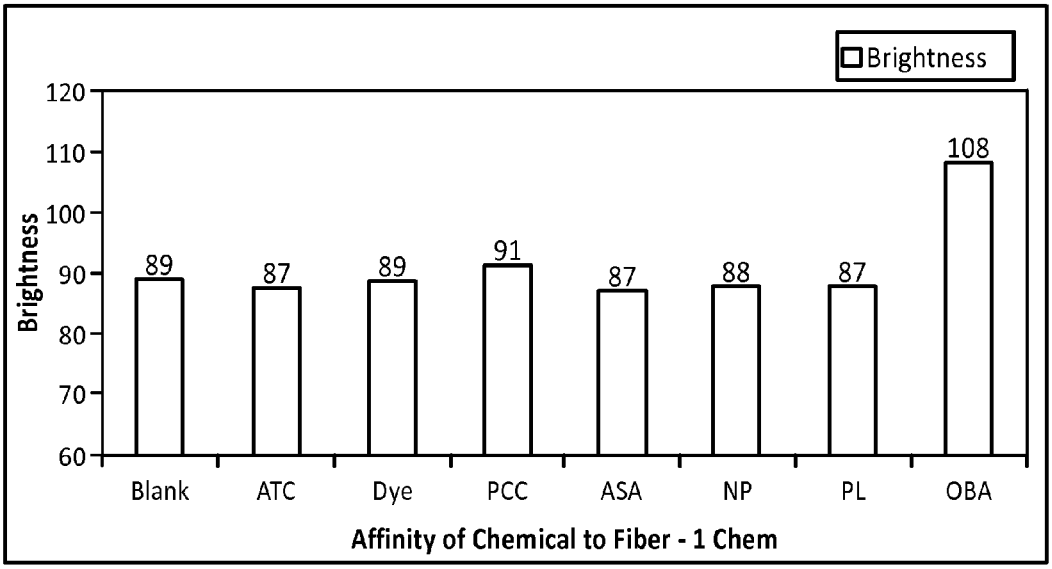
FIG. 11 is a graph showing the effect of various chemicals on paper brightness.

FIG. 11 shows that from the chemicals added to the handsheets, the OBA had the highest increase in brightness and therefore had the best affinity for the fiber with a 19 point increase of brightness when compared to PCC (the second highest increase) which only increased by 2 points. Dye had no influence on brightness and addition of the other chemicals caused brightness loss.

Figure 12:
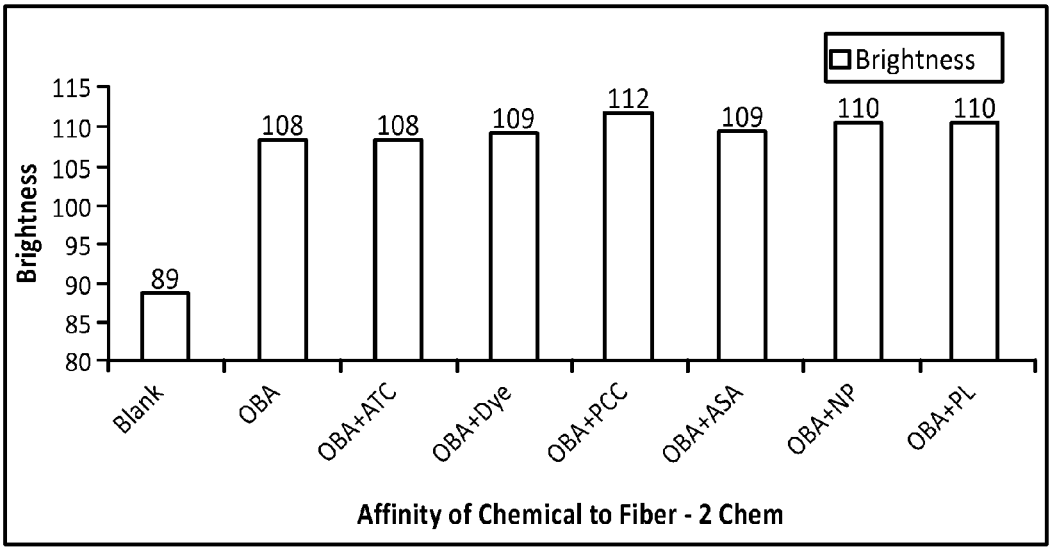
FIG. 12 is a graph showing the effect of various chemical combinations (2 chemical system) on paper brightness.
Figure 13:
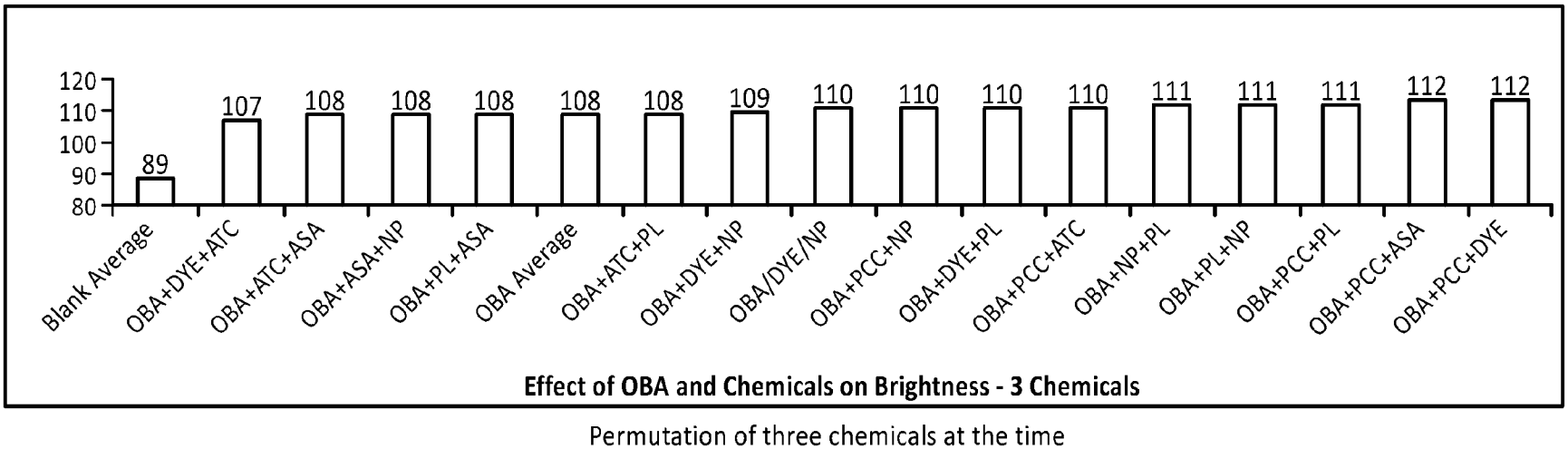
FIG. 13 is a graph showing the effect of various chemical combinations (3 chemical system) on paper brightness.

FIG. 12 shows the handsheet brightness effect of when the OBA is combined with the above chemicals at the wet end. The best brightness is obtained when OBA is combined with PCC. This combination increases the brightness from 108 to 112 points.

The addition of a third chemical did not improve the brightness of the handsheets over two chemicals. The brightness was at the same level as the best performing combination of OBA and PCC when two chemicals were added to the fibers. The best performing combinations from the three chemicals addition sequences were the chemical sequences of OBA+PCC+ASA and OBA+PCC+DYE. However, the addition of either ASA or DYE to the OBA+PCC mixture did not increase the brightness above 112 points indicating that for this set of experiments the chemical sequence at the wet end had reached a ceiling.

Table 8 shows that some chemical sequences react more favorably than others to the surface OBA. In Table 8 we can see that the same amount of surface OBA is more effective at increasing brightness for the OBA+PCC+ASA sequence (which reaches 115.9 brightness points) rather than OBA+PCC+PL sequence (with only 110.75 brightness points). Similarly, the sequence of OBA+Dye+PCC is even a better permutation because the handsheet has a brightness of 116.53 points. The Table also shows that when there are no wet end chemicals other than OBA the surface OBA increases the brightness of the paper by a modest 1.5 points. The above indicates that wet end chemicals and their sequence are very important to increase brightness of paper.

TABLE 8

Handsheets with wet end and surface OBA

| | Uncoated | | Coated | |
|---|---|---|---|---|
| | | | Brightness | Whiteness |
| Chemical Sequences | Brightness Wet End | Whiteness Wet End | Wet End and Size Press | Wet End and Size Press |
| Blank | 88.64 | 86.70 | 106.61 | 145.82 |
| PCC | 91.26 | 86.43 | 110.63 | 145.04 |
| OBA | 108.23 | 139.72 | 109.94 | 149.69 |
| OBA + PCC | 111.97 | 143.88 | 116.53 | 156.63 |
| OBA + DYE + PCC | 112.49 | 146.54 | 116.96 | 157.67 |
| OBA + PCC + ASA | 112.44 | 141.46 | 115.9 | 152.61 |
| OBA + PCC + ATC | 110.45 | 138.54 | 114.9 | 150.79 |
| OBA + PCC + NP | 110.3 | 138.04 | 112.76 | 147.21 |
| OBA + PCC + PL | 111.06 | 137.94 | 110.75 | 141.91 |

Figure 14:
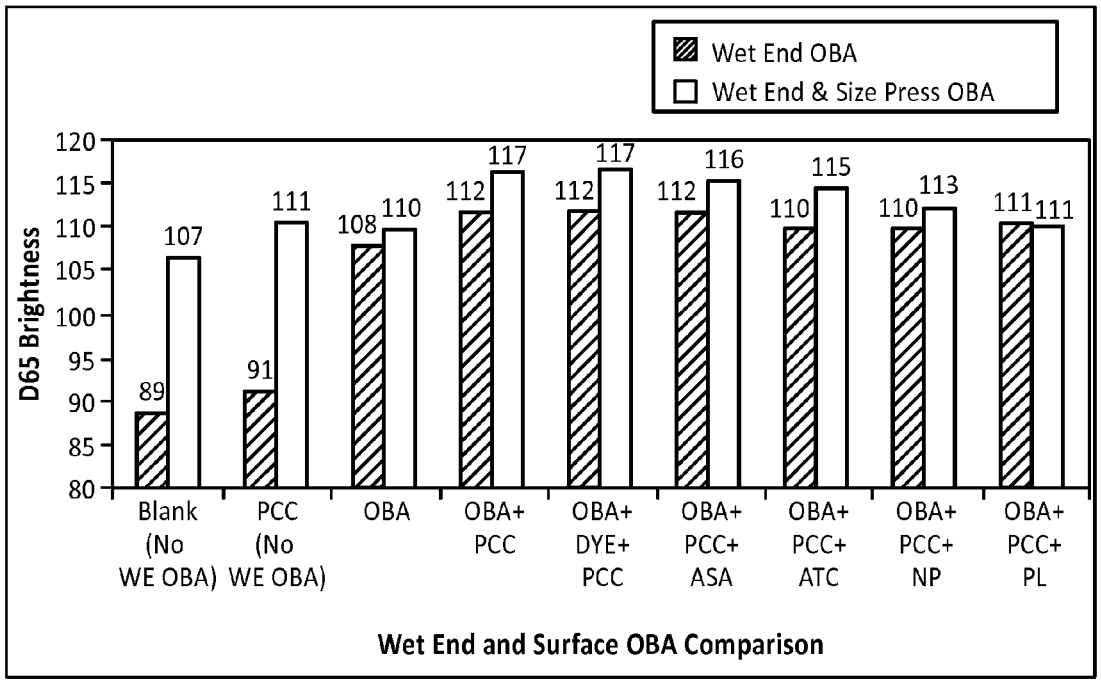
FIG. 14 is a graph showing the effect of wet end and surface OBA addition on paper brightness.

A review of Table 8 and FIG. 14 reveals that the sequences of OBA+Dye and OBA+Dye+PCC have the highest brightness and that OBA+PCC+PL has the lowest brightness indicating that PL should not follow the PCC.

In another experiment, the starch on the ASA was replaced with Stalok potato starch and the polymer PL8430 was replaced with PL2510 to make the system more cationic (Table 9).

TABLE 9

Summary of chemical charges

| Chemicals | Experiments 1-Chem to 3-Chem Chem # | Charge | Experiments 4-Chem to all Chem Chem # | Charge |
|---|---|---|---|---|
| OBA Di | Optiblanc | Anionic (1740-1750) | | |
| OBA Tetra | Optiblanc | Anionic (1444) | | |
| Dye | | Anionic | | |
| ASA | | Cationic (.3) | w/potato starch | |
| PL | 8430 | Too sticky (anionic) | 2510 | Cationic 10 |
| NP (silica) | 442 | Anionic (1765-1780) | | |
| ATC | 5432 | Cationic (10) | | |
| PCC | | Anionic (1351) | | |

Stalok 400 potato starch and PL 2510 were used for the 4-chemical (and subsequent) addition sequences.

Figure 15:
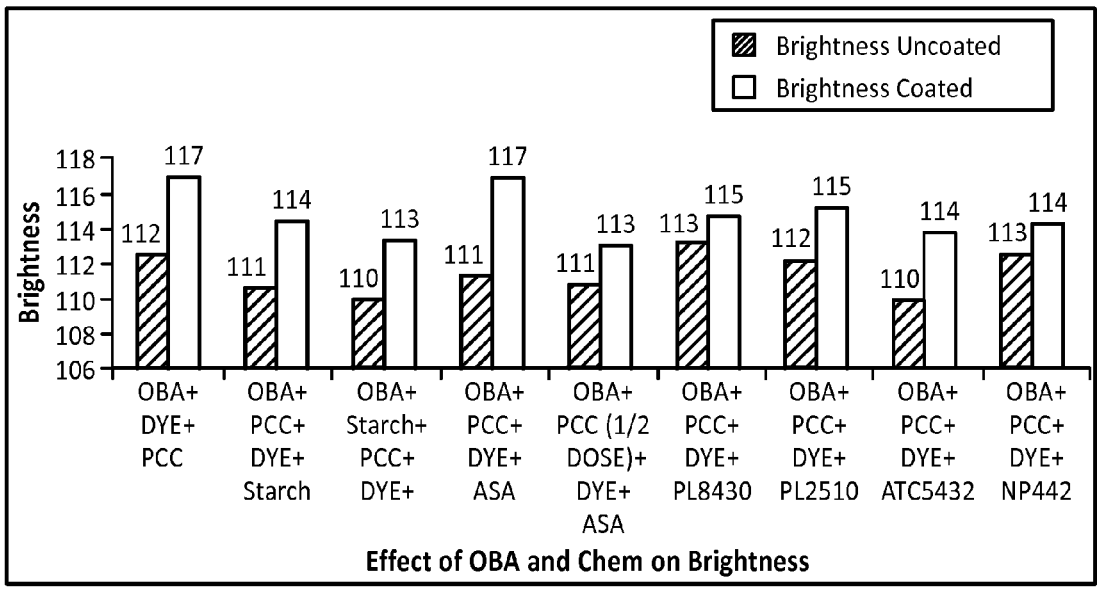
FIG. 15 is a graph showing the effect of various chemical combinations (4 chemical system) on paper brightness.
Figure 16:
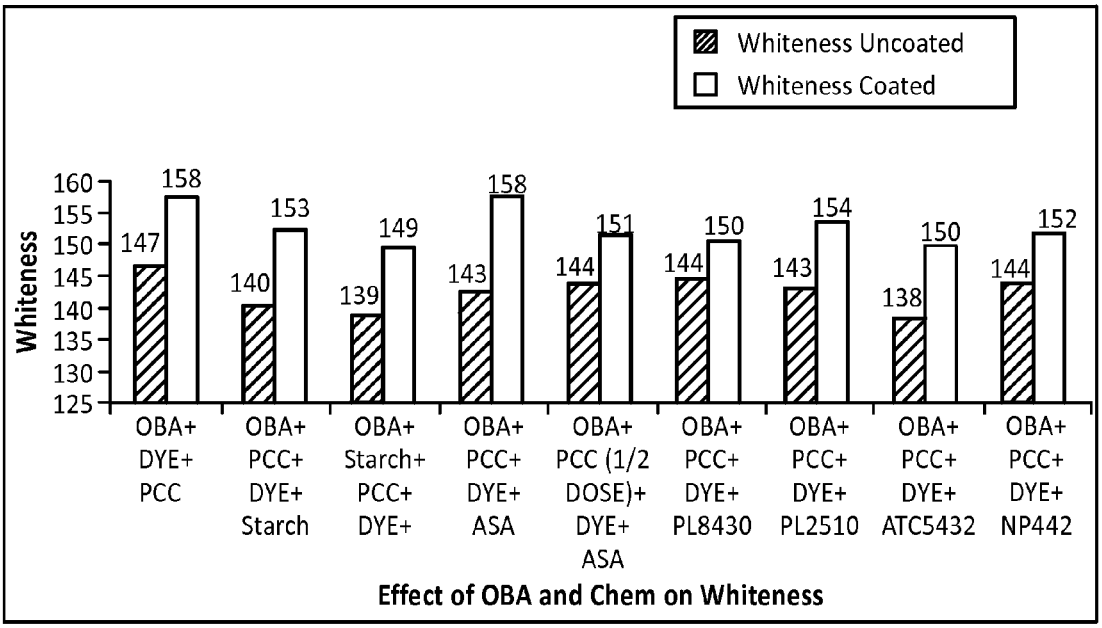
FIG. 16 is a graph showing the effect of various chemical combinations (4 chemical system) on paper whiteness.

As can be seen in FIGS. 15 and 16, the best 4-chemical sequence "OBA+PCC+DYE+ASA" achieved the coated brightness and whiteness level of the 3-chemical sequence OBA+DYE+PCC. The rest of the conditions failed to reach this brightness or whiteness.

The best 4-chemical sequence from FIGS. 15 and 16 was chosen as a control and different chemicals were added to the control to assess the effect that these chemicals have in improving the brightness and whiteness of the control sequence. A review of FIGS. 17 and 18 reveals that "OBA+PCC+DYE+ASA+PL8430" is the best 5-chemical sequence to achieve higher brightness and whiteness than the control 4-chemical sequence.

Figure 17:
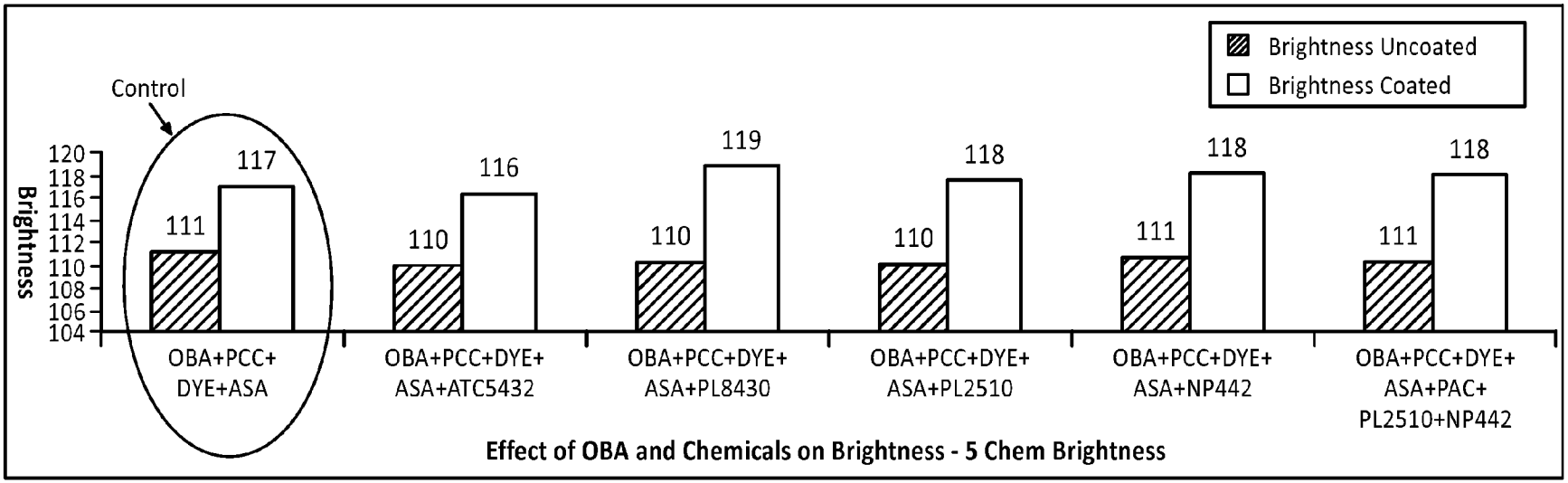
FIG. 17 is a graph showing the effect of various chemical combinations (5 chemical system) on paper brightness.
Figure 18:
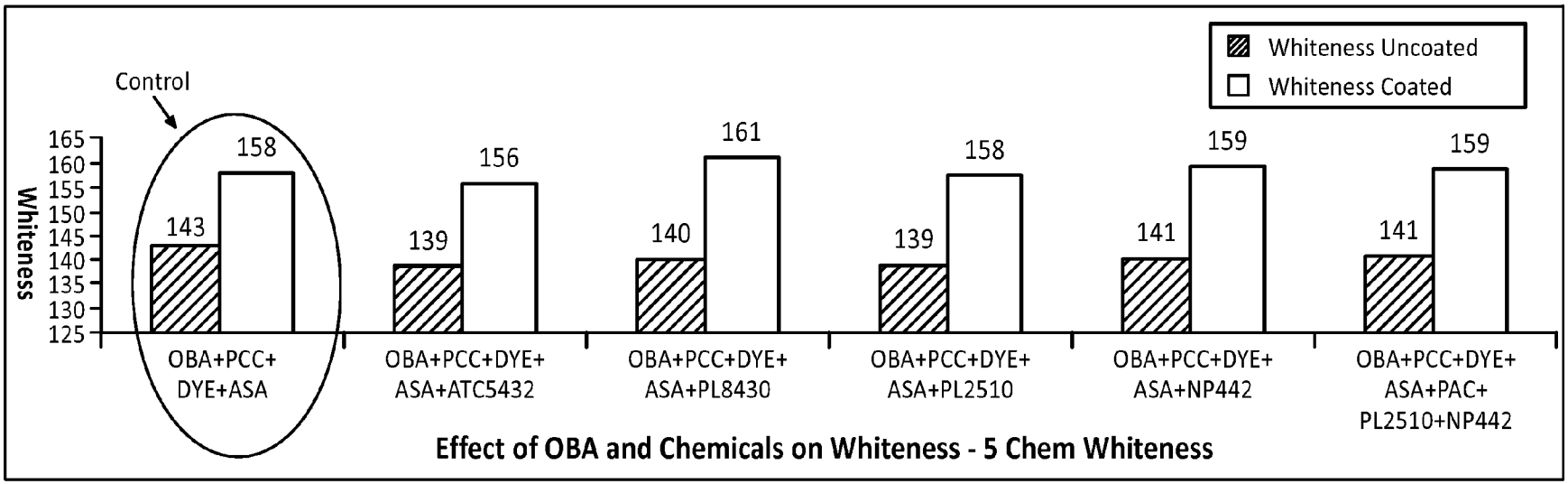
FIG. 18 is a graph showing the effect of various chemical combinations (5 chemical system) on paper whiteness.
Figure 19:
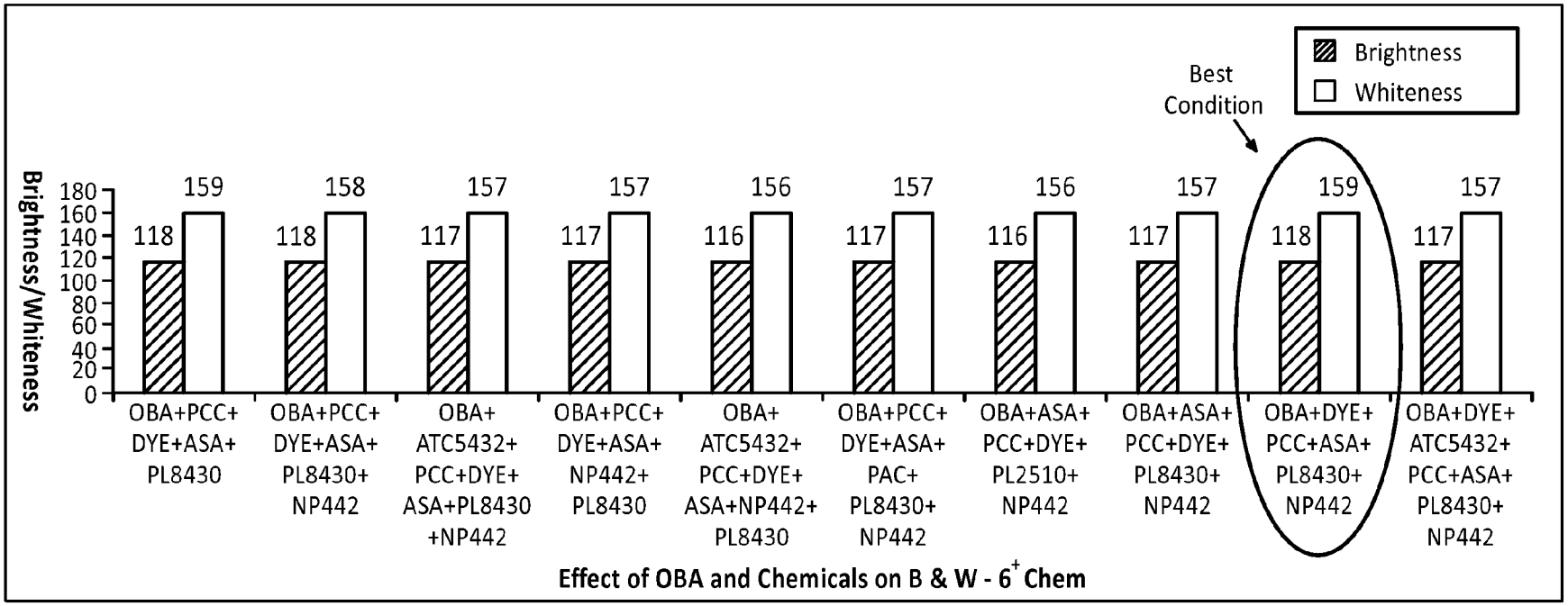
FIG. 19 is a graph showing the effect of various chemical combinations (6 chemical system) on paper brightness.

Similarly, the best 5-chemical sequence of FIGS. 17 and 18 is chosen as the control and others chemicals are added to the chemicals in this sequence. FIG. 19 shows different chemical sequences with high brightness and whiteness. The 6-chemical sequence and dosage is given in Table 10 below.

TABLE 10

| 6-chem sequence dosage | | | | | | |
|---|---|---|---|---|---|---|
| Wet End OBA Lb/T | Dye Lb/T | PCC Lb/T | ASA/ Stalok- Lb/T | PL 8430 Lb/T | NP442 Lb/T | Surface OBA Lb/T |
| 20 | 0.1 | 400 | 2 | 1 | 1 | 10 |

This set of experiments has shown that the interaction between the sequence of chemicals and the wet end and surface OBA is very important to obtain the highest brightness and whiteness of paper.

Example 3

The pulp used for this set of experiments had a low initial brightness. The hardwood brightness was 86.16 for and softwood brightness was 87.42 points. The whiteness was 71.83 and 80.31 respectively. The wet end OBA used was Leucophor T-100; the hardwood to softwood ratio was 70:30; and the refining levels are given in Table 11. The chemical sequence used is the one in table 10.

TABLE 11

| Refining Freeness | | | | | | |
|---|---|---|---|---|---|---|
| Levels | R1-Unr | R2 | R3 | R-IP | R4 | R5 |
| SW | 640 | 540 | 460 | 450 | 350 | 305 |
| HW | 623 | 573 | 430 | 330 | 320 | 240 |
| 70% HW | 628 | 563 | 439 | 366 | 329 | 260 |

Figure 20:
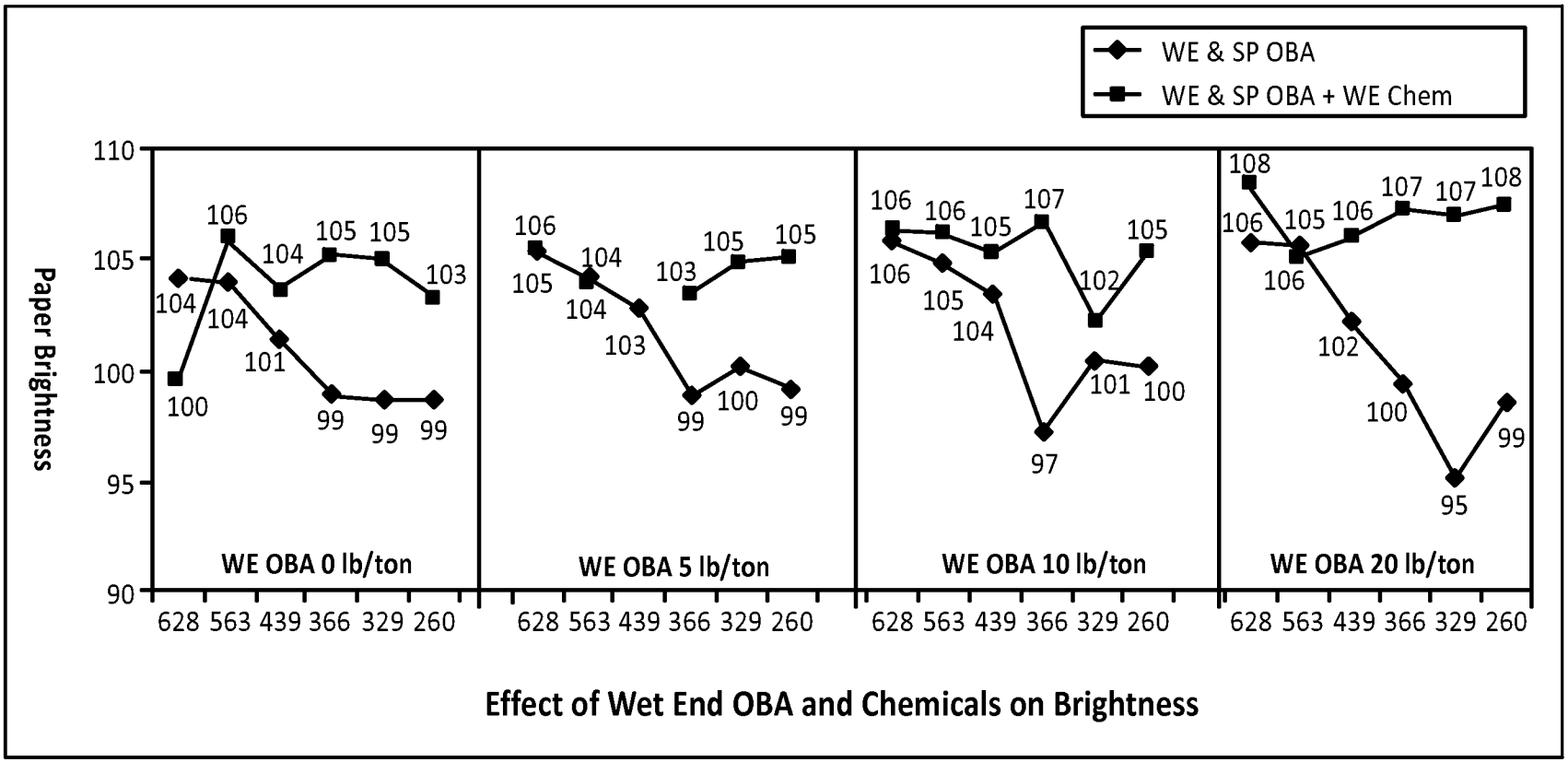
FIG. 20 is a graph showing the effect of wet end chemicals in combination with wet end and surface OBA on paper brightness.

This set of experiments shows that, if the chemicals added to the wet end have the correct sequence and dosages, there is no brightness loss due to refining. FIG. 20 shows the comparison between two different sets of handsheets. Both sets have the same amount of OBA at the wet end and size press. One set of handsheets has in addition to the OBA, chemicals added to the wet end. The chemicals used and the addition sequences are given in Table 10. The OBA used is Leucophor T-100 and the starch in the ASA was replaced with Stalok 400 starch.

A review of FIG. 20 reveals the following:

1. There is a decrease in brightness due to refining when only OBA is added to the wet end and size press.
2. There is virtually no brightness loss due to refining with the addition of the wet end chemicals in the sequence given in FIG. 19.
3. There is a modest increase in brightness when the wet end OBA is increased from 0 lb/ton to 20 lb/ton for the handsheets that have internal and surface OBA (WE & SP OBA) and no wet end chemicals.

Figure 21:
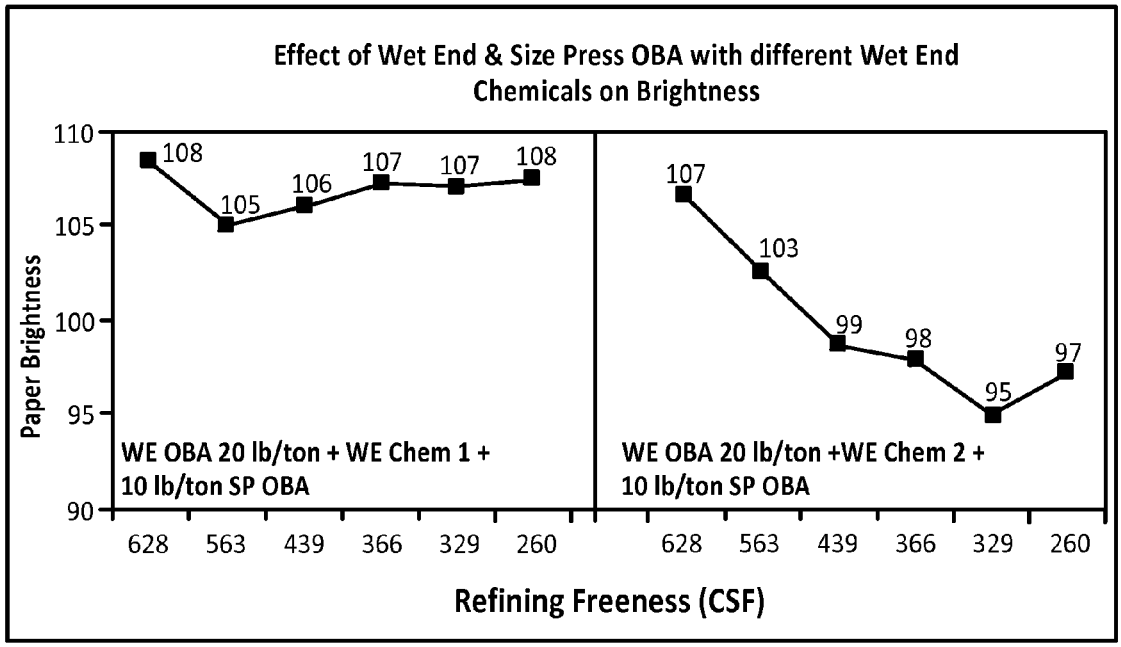
FIG. 21 is a graph showing the effect of different wet end chemicals in combination with wet end and surface OBA on paper brightness.

However, if a different process and chemical sequence is used, there is considerable brightness loss as demonstrated in FIG. 21. FIG. 21 shows the effect that other processes and wet end chemicals have on brightness. The handsheets of the set on the left hand side of FIG. 21 were made with the chemicals, sequences, and dosages that are shown in Table 10 above. The handsheets on the right hand side were made with pulp that had been PCC base loaded, i.e., the PCC was added prior to adding the chemicals and OBA. The sequence and dosages are given in Table 12.

TABLE 12

| Wet end sequence and dosage for base loaded pulp | | | | | | | |
|---|---|---|---|---|---|---|---|
| Wet End OBA Lb/T | Dye Lb/T | Alum Lb/T | Amylofax 3300 Lb/T | PL 1610 Lb/T | NP320 Lb/T | BMA-0 Lb/T | Surface OBA Lb/T |
| 20 | 0.1 | 2 | 10 | 0.3 | 1.25 | 1.25 | 10 |

A review of FIG. 21 reveals that while the refined handsheets on the RHS of the figure, loose brightness significantly due to refining, the handsheets on the left preserve the brightness even at the lowest freeness level.

Figure 22:
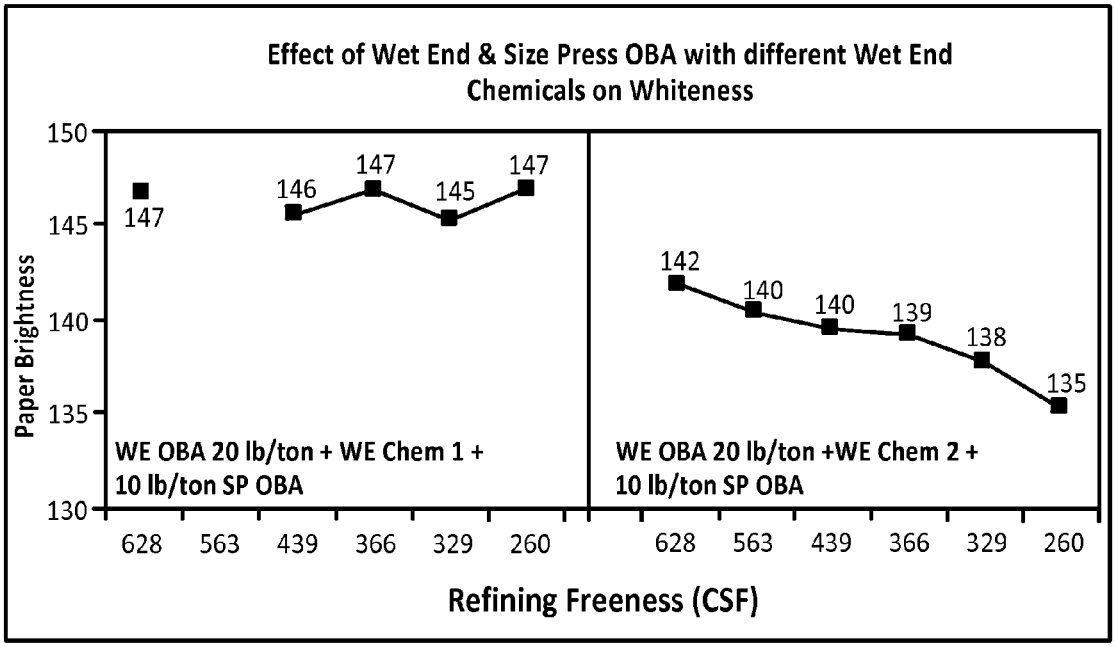
FIG. 22 is a graph showing the effect of different wet end chemicals in combination with wet end and surface OBA on paper whiteness.

A similar trend is observed with respect to the whiteness. FIG. 22 shows that the whiteness (LHS) with the chemical sequence circled in FIG. 19 (WE Chem1) compared to the PCC loaded chemical sequence (WE Chem 2). A review of FIG. 22 reveals that the handsheets on the LHS have significantly higher overall whiteness at any refining level ranging from 5 points higher brightness at 628 CSF to 12 points at 260 CSF.

Overall, the above examples show:

1. an unusual brightness increase peak at around the fiber delamination point when OBA (mixed in PVOH) is added to the surface of the paper. This means that mills can refine to a lower freeness (around or at the fiber delamination point) without reducing the brightness or whiteness of the paper.
2. Finding several chemical sequences (shown in FIG. 19) and their dosages (Table 10) that increase the brightness and whiteness of the paper to the highest industry standards using less OBA than current mill practices.
3. The combination of OBA with certain chemical addition sequences and surface OBA mixed with starch or PVOH instead of loosing brightness due to refining (as is well documented in the literature) maintain the brightness even a very low freeness.
4. Similarly, whiteness is not only preserved in the handsheets made with the selected chemical sequence, but higher than the handsheets with the PCC base loaded chemistry.

Example 4

Experiments were conducted to evaluate the effect of surface OBA used at the size press on brightness and whiteness of the paper.

Figure 23:
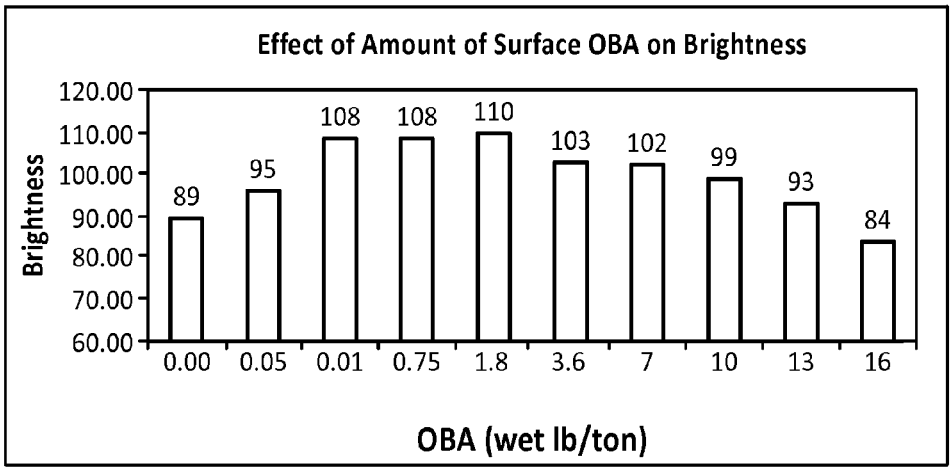
FIG. 23 is a graph showing the effect of OBA dose on brightness.

FIG. 23 below shows the effect of OBA on D65 brightness. The handsheets were made with 100% softwood pulp from the P stage with a pulp brightness of 92.31 and 7.07 pulp pH. The handsheets had no chemicals added at the wet end. Surface OBA Optiblanc 3V was used at the size press at different OBA levels. The OBA was mixed with PVOH at 8.3% solids. The Figure shows the effect the dosage of OBA has on brightness of the paper. The OBA and PVOH dose in ml is given in Table I and the wet lb/ton is shown in FIG. 23.

TABLE I

| OBA and PVOH Dose | | |
|---|---|---|
| Condition # | OBA and PVOH Dose | OBA Dose (ml) mixed in 15 ml PVOH |
| Blank 0 | Control | 0 |
| Blank 11 | 0.1 ml OBA in 240 ml PVOH | 0.00625 |
| Blank 10 | 0.1 ml OBA in 120 ml PVOH | 0.0125 |

TABLE I-continued

| OBA and PVOH Dose | | |
|---|---|---|
| Condition # | OBA and PVOH Dose | OBA Dose (ml) mixed in 15 ml PVOH |
| Blank 9 | 0.1 ml OBA in 60 ml PVOH | 0.025 |
| Blank 8 | 0.1 ml OBA in 30 ml PVOH | 0.05 |
| Blank 7 | 0.1 ml OBA in 15 ml PVOH | 0.1 |
| Blank 6 | 0.25 ml OBA in 15 ml PVOH | 0.25 |
| Blank 1 | 0.5 ml OBA in 15 ml PVOH | 0.5 |
| Blank 2 | 1.0 ml OBA in 15 ml PVOH | 1 |
| Blank 3 | 1.5 ml OBA in 15 ml PVOH | 1.5 |
| Blank 4 | 2.0 ml OBA in 15 ml PVOH | 2 |
| Blank 5 | 2.5 ml OBA in 15 ml PVOH | 2.5 |

Figure 24:
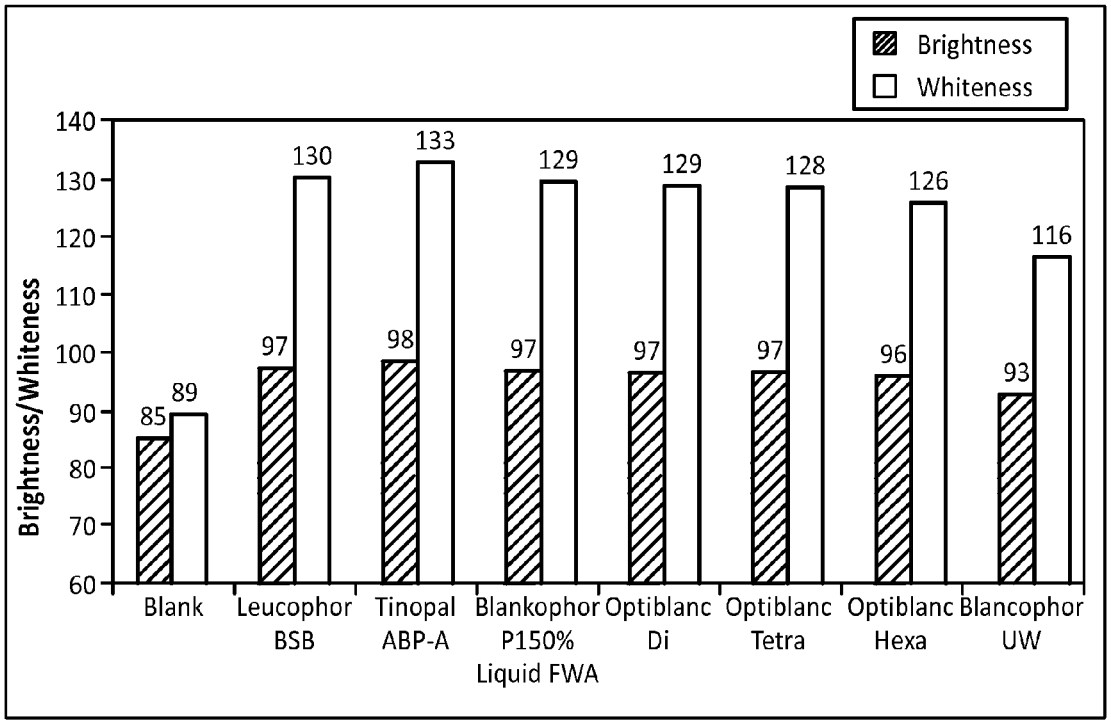
FIG. 24 is a graph showing the effect of OBA type on brightness and whiteness.

FIG. 24 shows the effect different types of OBA have on brightness of the surface of copy paper. 1 ml of the OBA was mixed in 15 ml of PVOH. Copy paper has a D65/10 brightness of 85 and whiteness of 89. The graph shows that Tinopal has slightly better brightness and whiteness than the other OBA products.

Table II shows the Ionic charges and type of OBA products. Solids for all OBA range from 40%-60%

TABLE II

| OBA, Ionic Charges and Type. | | |
|---|---|---|
| Name | Ionic Charge | OBA Type |
| Blankophor UW Liquid | −50 | Hexa |
| OptiBlanc XLN | −57 | Hexa |
| Leucophor T4 | −58 | Tetra |
| Tinopal ABP-A | −85 | Tetra |
| Blankophor P150% Liquid | −97 | Tetra |
| Leucophor T100 | −107 | Tetra |
| Leucophor CE | −132 | Tetra w/ Carrier |
| Tinopal PT | −1490 | Tetra |
| Blankophor DS | −224 | Di |
| Tinopal HW | −156 | Di |
| OptiBlanc NL | −245 | Di |

Figure 25:
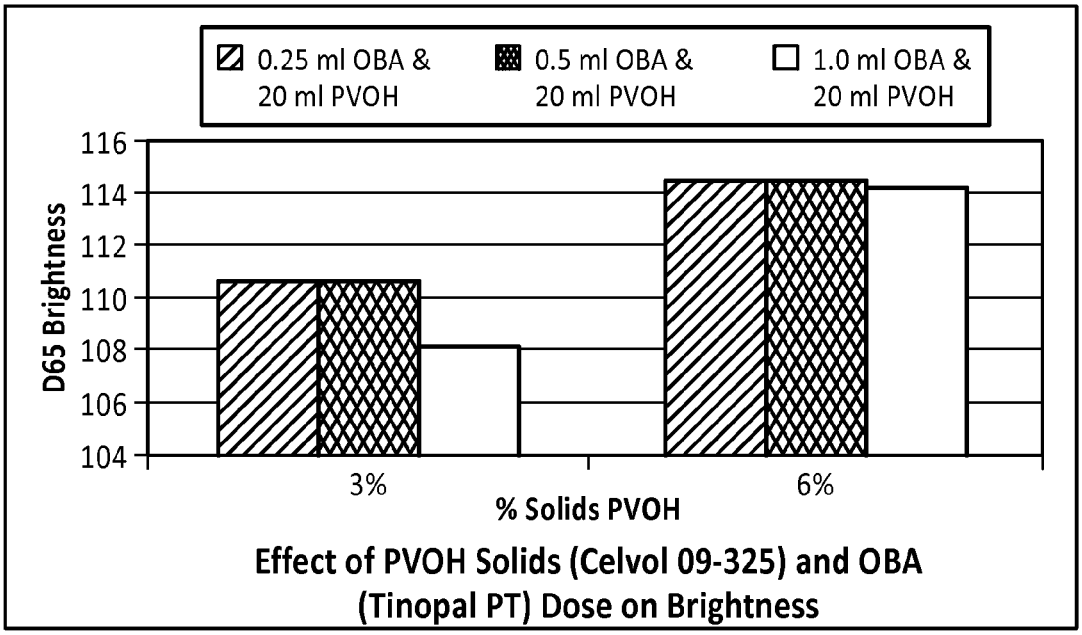
FIG. 25 is a graph showing the effect of PVOH solids on brightness.

Tinopal ABP-A is a tetra optical brightener agent and so is Tinopal PT. Tetrasulfonate OBA can be used at both the wet end and size press. Tinopal PT was studied in combination with non-ionic PVOH Celvol 09-325 at different percentage solids. The percentage solids of PVOH seem to have an effect on the D65/10 brightness of surface treated paper. For this set of experiments, PVOH Celvol 09-325 and 24-203 were used at different percentage solids and OBA Tinopal PT at different dosage levels. The paper was Offset and the brightness was 102. It was observed that Tinopal PT (tetra) is not compatible with PVOH 09-325 at 9% solids. Therefore, the experiments were continued at higher solids (12%) with PVOH Celvol 24-203. FIG. 25 shows that as the percentage solids increased from 3% to 6%, the brightness of the paper increased.

Figure 26:
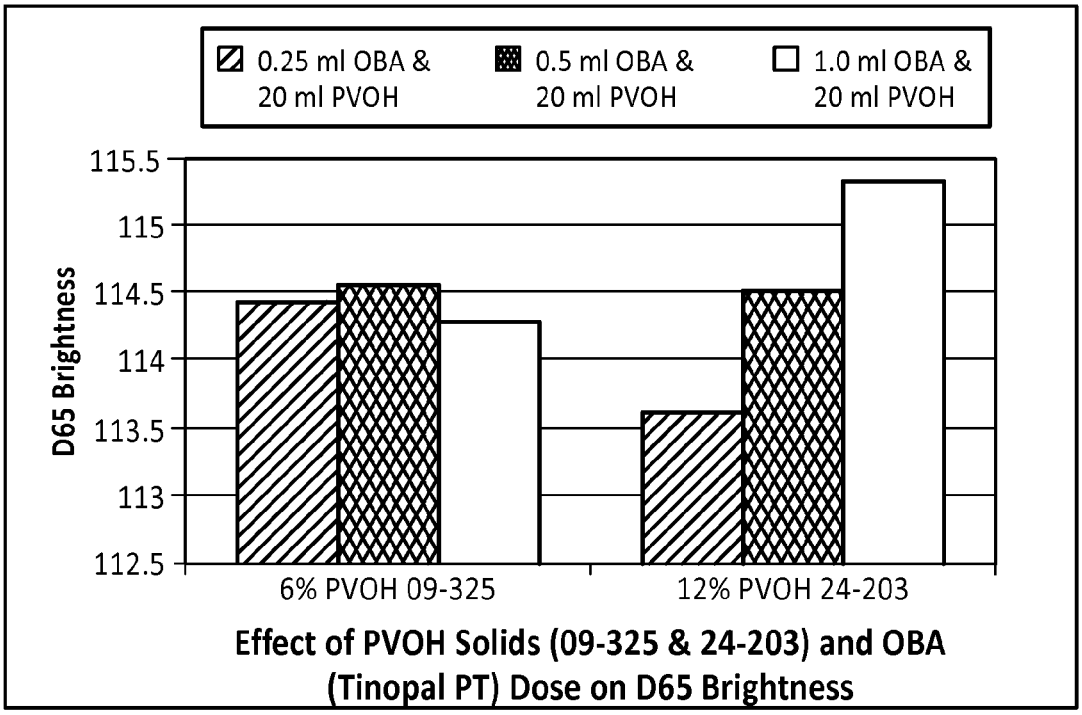
FIG. 26 is a graph showing the effect of PVOH types/amount on paper brightness.

FIG. 26 shows the performance of PVOH Celvol 24-203 at 12% solids. The graph shows that with this PVOH, higher brightness can be achieved with higher dosage of OBA, but at lower dosage (0.25 ml) the brightness of the paper is better when 09-325 is used. The brightness is comparable at 0.5 ml OBA for both PVOH 09-324 and 24-203.

Figure 27:
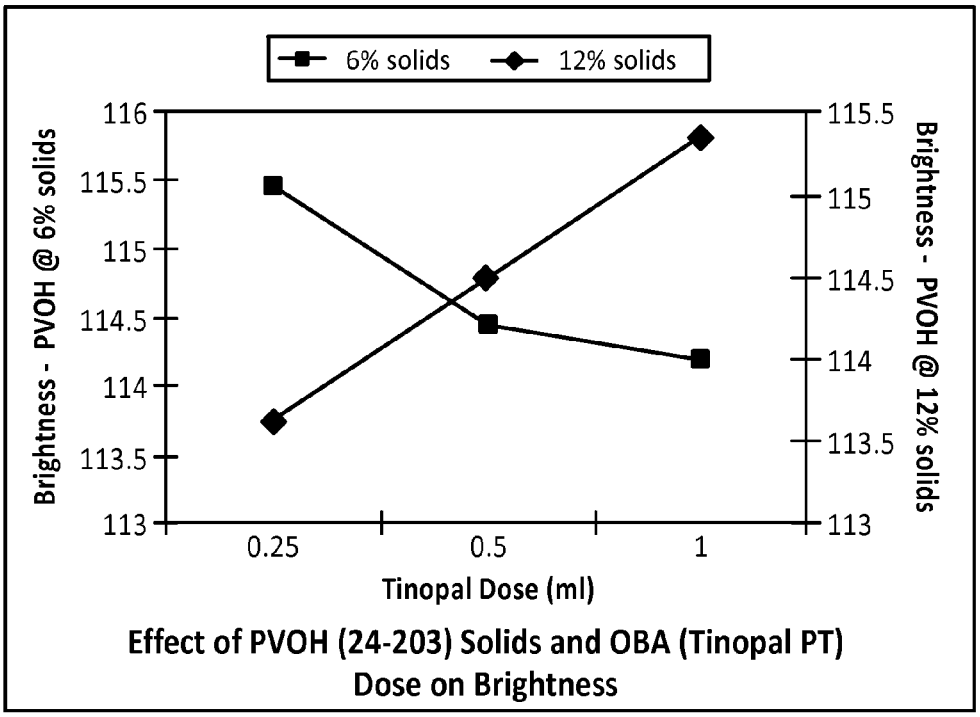
FIG. 27 is a graph showing the effect of PVOH 24-203 percent solids on paper brightness.
Figure 28:
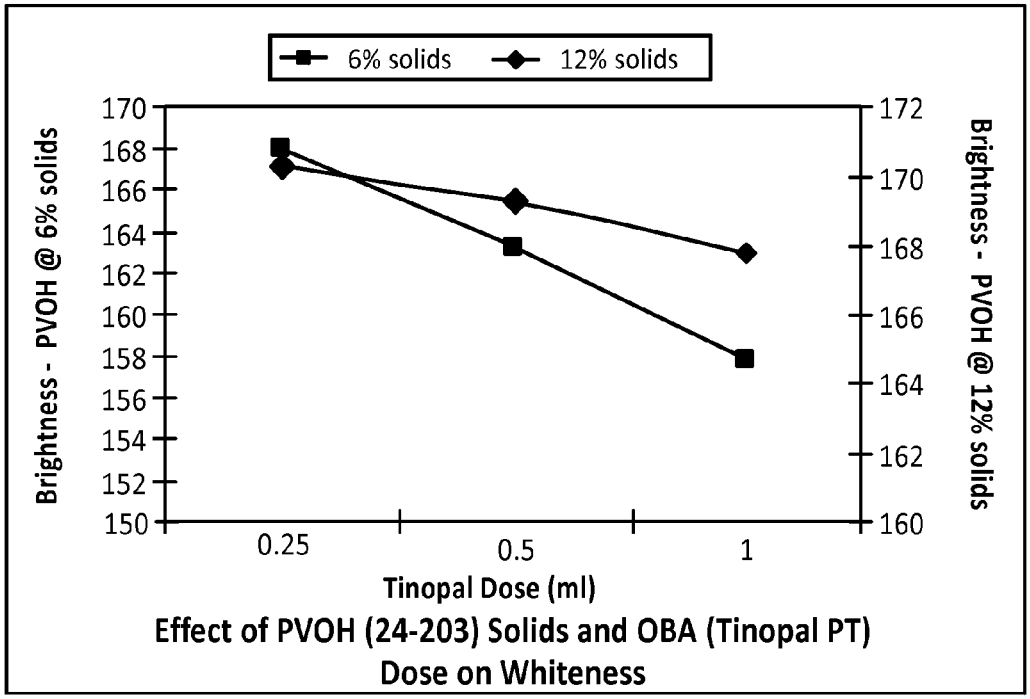
FIG. 28 is a graph showing the effect of PVOH 24-203 percent solids on paper whiteness.

FIGS. 27 and 28 show that Tinopal affects the brightness and whiteness of the paper according to the percentage solids of PVOH Celvol 24-203 and the dosage of OBA. FIG. 27 shows that as the OBA is increased, brightness drops at 6% PVOH solids and increases at 12% solids. FIG. 28 shows that as the amount of OBA increases the whiteness of paper decreases with PVOH at both 6 and 12%.

FIGS. 27 and 28 show that to achieve better brightness and whiteness with Tinopal the best condition is low OBA dosage (0.25 ml in 20 ml PVOH) and 6% PVOH Celvol 24-203 solids.

Since there could be some compatibility issues with PVOH and Tinopal OBA and due to the narrow operating window with respect to PVOH solids and OBA dosage, the performance of the next three best performers in FIG. 24 (Optiblanc, Blankophor, and Leucophor optical brightening agents) were also studied.

Figure 29:
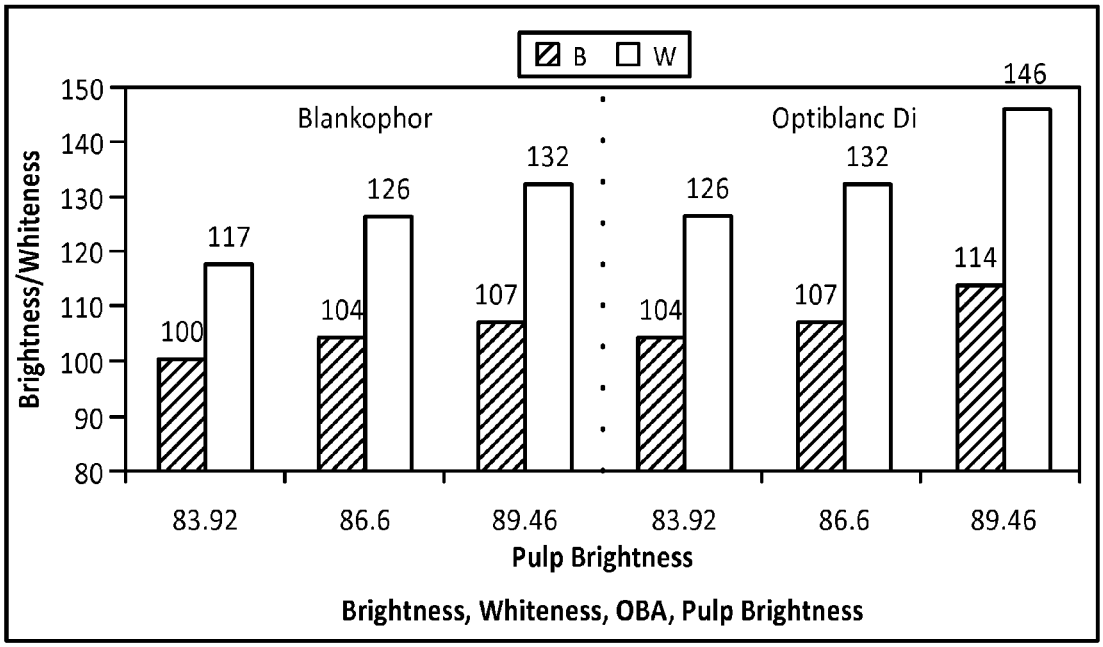
FIG. 29 is a graph showing a performance comparison between two OBA's on paper brightness.

Hardwood and softwood pulp (60:40) from three different bleaching stages (D1, D2, and P) and with pulp brightness of 83.9, 86.6, and 89.46 respectively were used to make handsheets. The handsheets were then coated with the mixture of OBA and PVOH. Results in FIG. 29 shows that Optiblanc performs better than Blankophor in both brightness and whiteness.

Figure 30:
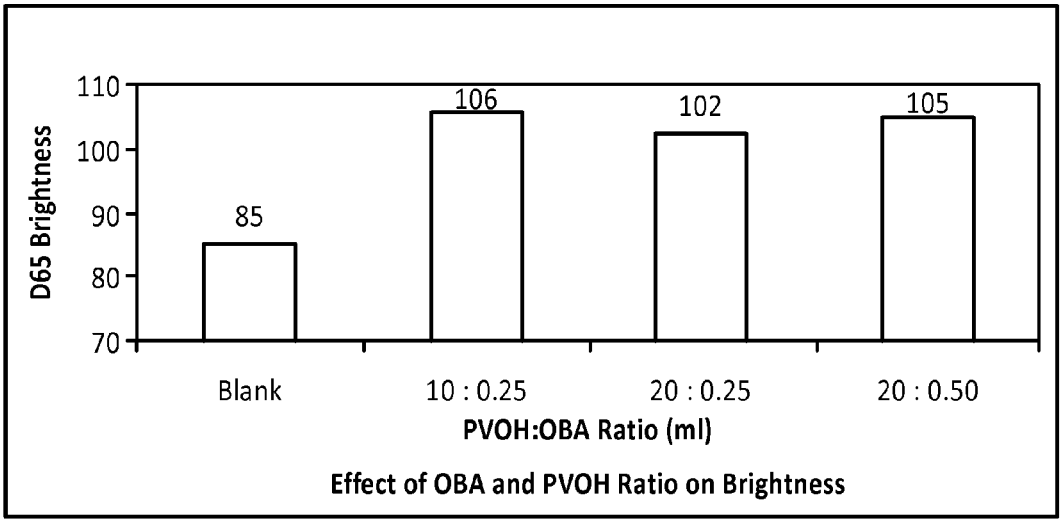
FIG. 30 is a graph showing the effect of surface addition of OBA and PVOH ratio on paper brightness.
Figure 31:
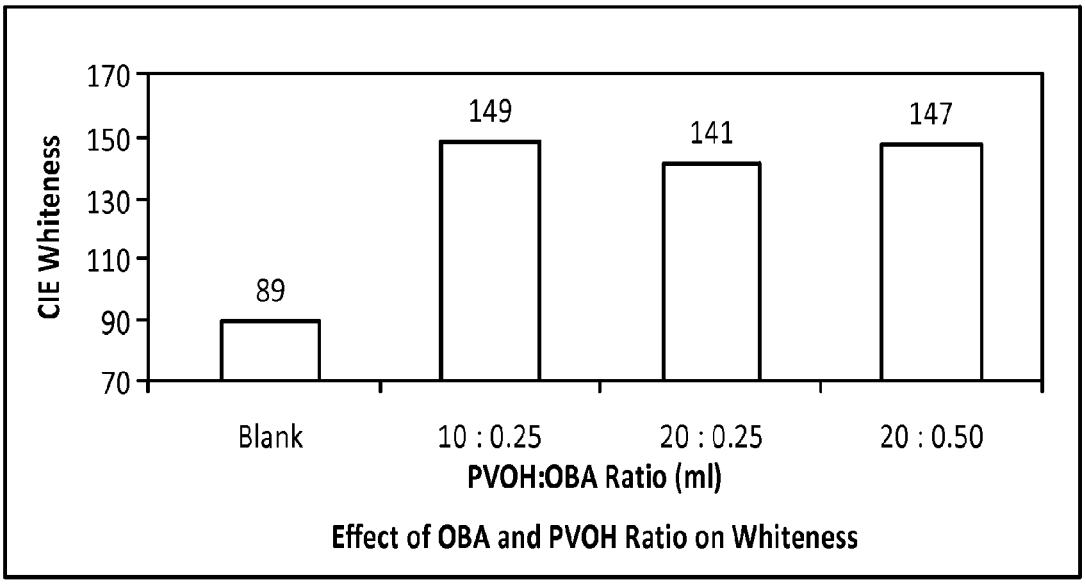
FIG. 31 is a graph showing the effect of surface addition of OBA and PVOH ratio on paper whiteness.

OBA Leucophor CE at 50% solids was mixed with PVOH Celvol 310 at 9.9% solids. FIGS. 30 and 31 show the effect the ratio of Leucophor CE and PVOH 310 have on brightness and whiteness of paper.

According to results on FIGS. 30 and 31 the best ratio to obtain better brightness and whiteness of paper is to use a ratio of 10 ml of PVOH to 0.25 ml of OBA. The coat weight of the PVOH:OBA ranges from 4 to 6 gsm.

Figure 32:
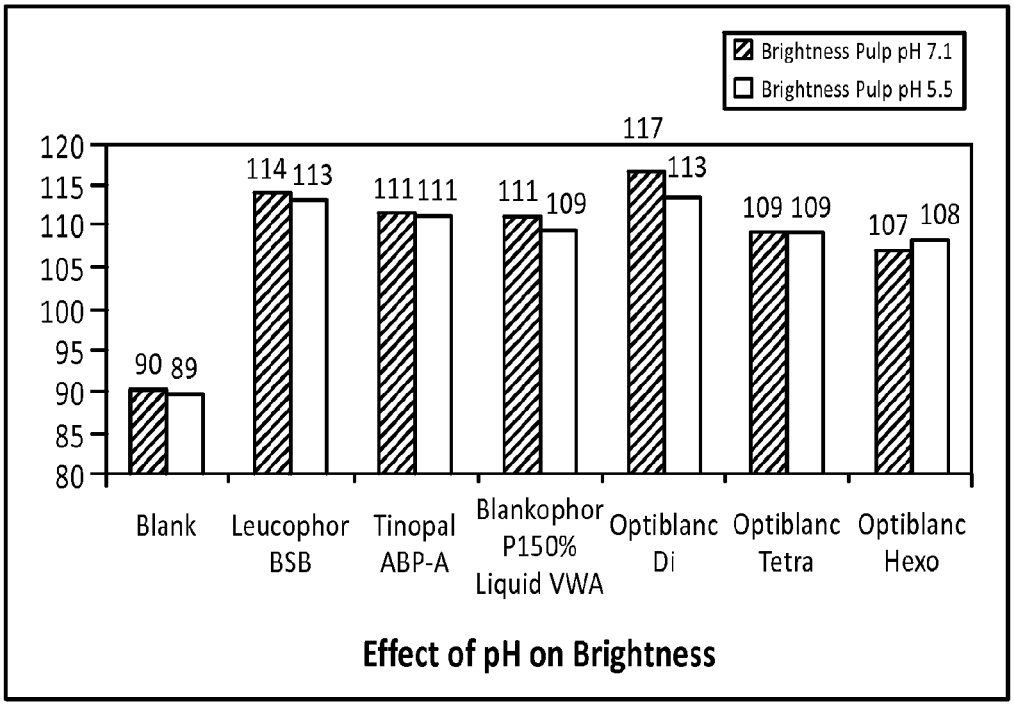
FIG. 32 is a graph showing the effect of pulp pH on different OBA's for paper brightness.
Figure 33:
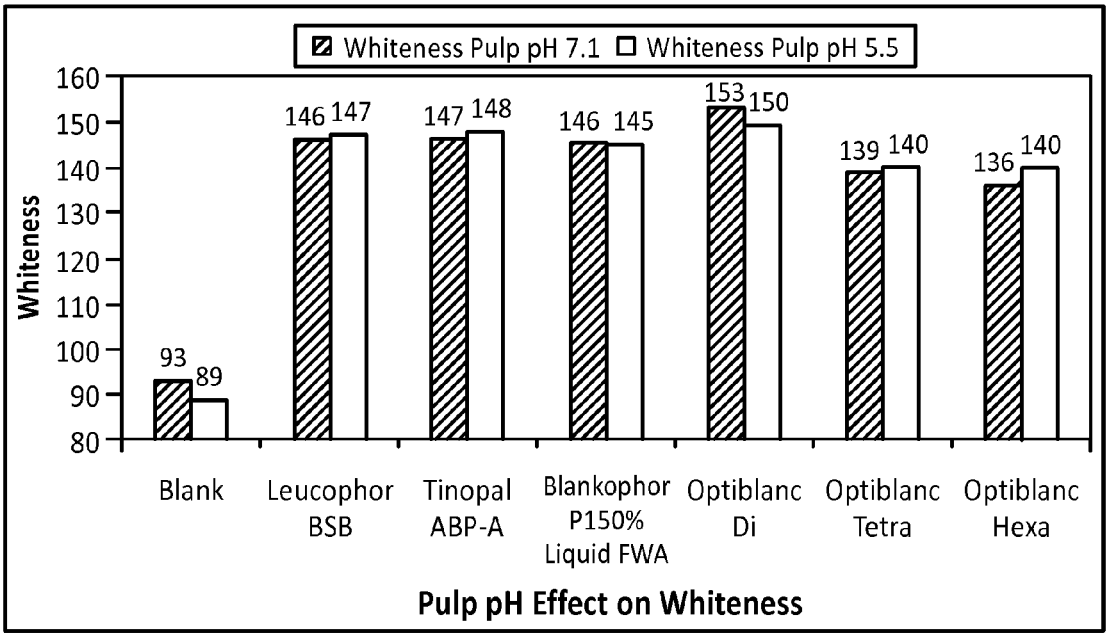
FIG. 33 is a graph showing the effect of pulp pH on different OBA's for paper whiteness.

The effect of pulp pH on brightness and whiteness was evaluated. FIG. 32 shows that for Leucophor and Optiblank Di pH 7.1 gives better brightness. For the other OBA there is no significant impact on brightness due to pH. Similarly, FIG. 33 shows that Optiblanc Di has better whiteness at a 7.1 pH.

Figure 34:
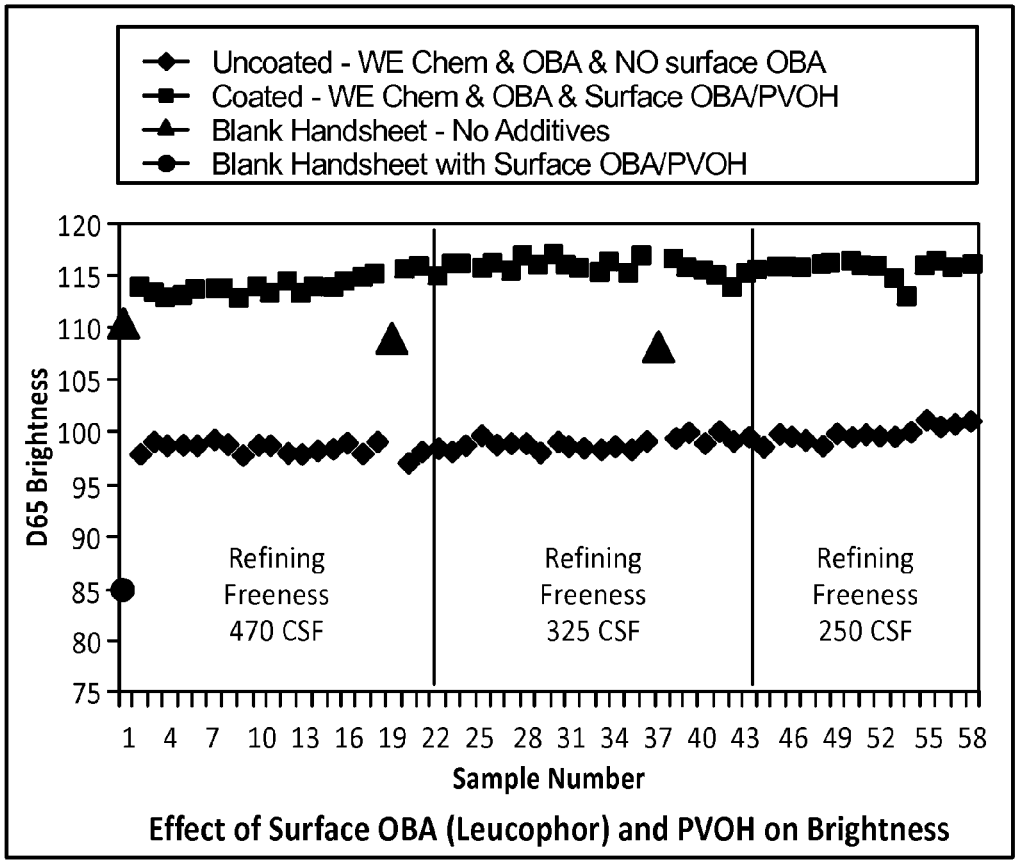
FIG. 34 is a graph showing the effect of OBA and PVOH on paper brightness for different freeness levels.

FIG. 34 shows the effect of surface addition of OBA Leucophor CE and PVOH (Celvol 310 or 325) on brightness. The graph shows brightness results for handsheets that have been made with: 1) wet end chemicals and OBA, but no surface OBA (uncoated), 2) wet end OBA and chemicals and surface OBA with PVOH, and 3) Blank handsheets with neither wet end chemicals or OBA nor surface OBA and PVOH.

The handsheets were made with 70:30 HW to SW ratio at three refining level (470, 324, and 250 CSF). The ratio of PVOH to Leucophor was 10 ml to 0.25 ml. The chemical sequence was similar to Wet End Chemicals 1 (Table 10 above) with OBA applied to the fiber as the first component. The surface was coated with a mixture of PVOH and Leucophor and the coat weight was approximately 4 gsm. FIG. 34 shows that there is a very significant increase in brightness when the coating is applied. The blank handsheets show a more significant increase in brightness of the paper when the surface was coated with the PVOH/Leucophor CE mixture. Similar results were obtained for the whiteness.

What is claimed is:

1. A method of making paper from refined pulp comprising refining a cellulosic fiber suspension to reduce the freeness level an amount in the range from about 100 to about 400 CSF and contacting said cellulosic fibers with at least one disulfonate or tetrasulfonate stilbene based optical brightening agent (OBA) by adding the OBA to the refined fiber suspension in a wet end of a papermaking process prior to adding any additional wet end chemicals and then adding filler and dye in the wet end after the OBA is added and prior to adding any additional wet end chemicals.

2. A method according to claim 1, further comprising adding an OBA composition in a size press to the paper surface, wherein said OBA composition comprises at least one disulfonate or tetrasulfonate stilbene based OBA and at least one polymeric carrier in amounts sufficient to increase the brightness and/or whiteness of the paper.

3. A method according to claim 2, wherein the OBA in the size press is added in an amount from about 0.5 to about 15 lbs/ton of pulp.

4. A method according to claim 3, wherein said polymeric carrier is polyvinyl alcohol (PVOH) and the weight ratio of PVOH:OBA is in the range of from about 1:1 to about 16:1.

5. A method according to claim 4, wherein the weight ratio of PVOH:OBA is in the range of from about 2:1 to about 8:1.

6. A method according to claim 1, wherein the filler is PCC filler.

7. A method according to claim 6, wherein the PCC is added in an amount from about 100 to about 600 lbs/ton of pulp and the dye is added in an amount from about 0.01 to about 0.25 lbs/ton of pulp.

8. A method according to claim 6, further comprising adding a retention system to the wet end after adding the PCC and dye, wherein the retention system includes an anionic polymer and a microgel or at least partially aggregated nanoparticle anionic silica sol.

9. A method according to claim 8, wherein the anionic polymer is added in an amount from about 0.1 to about 2.5 lbs/ton of pulp and the silica sol is added in an amount from about 0.1 to about 2.5 lbs/ton of pulp.

10. A method according to claim 8, further comprising adding a cationic composition to the wet end after the PCC and dye, and prior to adding the retention system, wherein the cationic composition includes a mixture of alkenyl succinic anhydride (ASA) and starch.

11. A method according to claim 10, wherein the weight ratio of ASA to starch is in the range of about 1:1 to about 1:5.

12. A method according to claim 11, wherein said cellulosic fiber suspension is refined to reduce the freeness level an amount in the range from about 150 to about 350 CSF.

13. A method according to claim 12, wherein said cellulosic fiber suspension is refined down to a freeness level that substantially corresponds to the fiber delamination point.

* * * * *